US010714838B2

(12) United States Patent
Kitamura et al.

(10) Patent No.: US 10,714,838 B2
(45) Date of Patent: Jul. 14, 2020

(54) ARRAY ANTENNA APPARATUS AND METHOD OF MANUFACTURING THE SAME

(71) Applicant: MITSUBISHI ELECTRIC CORPORATION, Chiyoda-ku, Tokyo (JP)

(72) Inventors: Yoichi Kitamura, Tokyo (JP); Takashi Maruyama, Tokyo (JP); Takeshi Nakazato, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 65 days.

(21) Appl. No.: 15/515,301

(22) PCT Filed: Oct. 13, 2015

(86) PCT No.: PCT/JP2015/078900
§ 371 (c)(1),
(2) Date: Mar. 29, 2017

(87) PCT Pub. No.: WO2016/067906
PCT Pub. Date: May 6, 2016

(65) Prior Publication Data
US 2017/0229784 A1 Aug. 10, 2017

(30) Foreign Application Priority Data
Oct. 30, 2014 (JP) ..... 2014-221437

(51) Int. Cl.
*H01Q 21/00* (2006.01)
*H01Q 21/06* (2006.01)
(Continued)

(52) U.S. Cl.
CPC ..... *H01Q 21/065* (2013.01); *H01Q 9/0414* (2013.01); *H01Q 21/0025* (2013.01); *H01Q 21/0093* (2013.01); *H01Q 23/00* (2013.01)

(58) Field of Classification Search
CPC ..... H01Q 1/38; H01Q 21/065; H01Q 9/0407; H01Q 23/00; H01Q 1/2283;
(Continued)

(56) References Cited

U.S. PATENT DOCUMENTS 5,404,581 A 4/1995 Honjo
6,184,832 B1 * 2/2001 Geyh ..... H01Q 21/0087 343/700 MS
(Continued)

FOREIGN PATENT DOCUMENTS

JP 3-182103 A 8/1991
JP 5-67919 A 3/1993
(Continued)

OTHER PUBLICATIONS

International Search Report (PCT/ISA/210) dated Dec. 8, 2015, by the Japanese Patent Office as the International Searching Authority for International Application No. PCT/JP2015/078900.
(Continued)

*Primary Examiner* — Linh V Nguyen
(74) *Attorney, Agent, or Firm* — Buchanan Ingersoll & Rooney PC

(57) ABSTRACT

An array antenna apparatus includes: a wiring substrate having a plurality of fed patch antennas and a plurality of active element circuits electrically connected to the plurality of fed patch antennas, respectively; and a plurality of antenna substrates each having a parasitic patch antenna. The plurality of antenna substrates are joined onto one wiring substrate. Thereby, it becomes possible to provide an
(Continued)

array antenna apparatus that can be reduced in size and has excellent antenna characteristics.

24 Claims, 33 Drawing Sheets

(51) Int. Cl.
*H01Q 9/04* (2006.01)
*H01Q 23/00* (2006.01)

(58) Field of Classification Search
CPC .... H01Q 21/0087; H01Q 21/064; H01Q 1/40; H01Q 21/0075; H01Q 9/0414; H01Q 21/24
USPC ..... 343/795, 853, 835
See application file for complete search history.

(56) References Cited

U.S. PATENT DOCUMENTS 7,924,227 B2 * 4/2011 Yamada ..... H01Q 9/0407 343/700 MS
9,659,904 B2 * 5/2017 Kamgaing ..... H01Q 21/0093
2003/0067410 A1 * 4/2003 Puzella ..... H01Q 9/0407 343/700 MS
2008/0079636 A1 * 4/2008 Mohamadi ..... H01L 23/66 343/700 MS
2008/0238793 A1 * 10/2008 Channabasappa ... H01Q 9/0457 343/767
2009/0009399 A1 * 1/2009 Gaucher ..... H01Q 21/0006 343/700 MS
2010/0126010 A1 * 5/2010 Puzella ..... H01Q 21/0087 29/852
2010/0227964 A1 * 9/2010 Long ..... C08K 3/04 524/496
2011/0080329 A1 * 4/2011 Nagel ..... H01Q 9/005 343/770
2011/0165839 A1 * 7/2011 Kawamura ..... G01S 7/032 455/41.1
2011/0298665 A1 * 12/2011 Wu ..... H01Q 1/088 343/700 MS
2012/0299671 A1 * 11/2012 Ikeda ..... H01J 37/32192 333/248
2013/0057365 A1 * 3/2013 Mizushima ..... H01P 1/047 333/238
2014/0252379 A1 * 9/2014 Sato ..... H01L 31/1844 257/85
2015/0285998 A1 * 10/2015 Babakhani ..... G02B 6/13 438/27
2016/0079672 A1 * 3/2016 Cerreno ..... H01Q 21/065 343/848
2016/0104940 A1 * 4/2016 Wang ..... H01Q 1/2283 343/836
2016/0141754 A1 * 5/2016 Leyh ..... H01Q 3/247 342/372
2017/0133756 A1 * 5/2017 Eastburg ..... H01Q 21/061
2017/0244174 A1 * 8/2017 Kawaguchi ..... H01Q 15/14
2018/0351262 A1 * 12/2018 Yoon ..... H01Q 1/2283

FOREIGN PATENT DOCUMENTS

JP 2000-196329 A 7/2000
JP 2001-7628 A 1/2001
JP 2003-234613 A 8/2003
JP 2005-117139 A 4/2005

OTHER PUBLICATIONS

Written Opinion (PCT/ISA/237) dated Dec. 8, 2015, by the Japanese Patent Office as the International Searching Authority for International Application No. PCT/JP2015/078900.
Office Action (Notification of Reasons for Refusal) dated Feb. 13, 2018, by the Japanese Patent Office in corresponding Japanese Patent Application No. 2016-556486 and English translation of the Office Action. (8 pages).

* cited by examiner

ARRAY ANTENNA APPARATUS AND METHOD OF MANUFACTURING THE SAME

TECHNICAL FIELD

The present invention relates to an array antenna apparatus configured to perform at least one of transmission and reception of electromagnetic waves such as a microwave and a millimeter wave, and a method of manufacturing the array antenna apparatus.

BACKGROUND ART

There is a known array antenna apparatus in which a plurality of antenna elements are arranged for performing at least one of transmission and reception of electromagnetic waves such as a microwave and a millimeter wave (see PTD 1 to PTD 3).

PTD 1 discloses an array antenna apparatus in which a plurality of antenna modules are mounted on a printed circuit board. Each of the plurality of antenna modules includes: a stacked substrate of multilayer ceramic provided with a patch antenna; and an electric element disposed in a cavity provided in the stacked substrate of multilayer ceramic.

PTD 2 discloses an array antenna apparatus configured by joining: one semi-insulating gallium arsenide substrate (semi-insulating GaAs substrate) having a plurality of antenna conductors and active element circuits; and one silicon substrate (Si substrate) including a plurality of signal processing circuits.

PTD 3 discloses an array antenna apparatus configured by stacking: one first dielectric substrate having a plurality of parasitic elements formed thereon; one second dielectric substrate having a plurality of radiation elements formed thereon; and one third dielectric substrate having a plurality of phase shifters formed thereon.

CITATION LIST

Patent Document

PTD 1: Japanese Patent Laying-Open No. 2005-117139
PTD 2: Japanese Patent Laying-Open No. 05-67919
PTD 3: Japanese Patent Laying-Open No. 2000-196329

SUMMARY OF INVENTION

Technical Problem

However, for reducing the size of the array antenna apparatus in PTD 1, the cavity also should be reduced in size. Accordingly, an electric element required for the array antenna apparatus cannot be arranged in the cavity. Consequently, it becomes difficult to reduce the size of the array antenna apparatus disclosed in PTD 1.

In PTD 2, a semi-insulating GaAs substrate and an Si substrate need to be joined to each other. However, in general, two substrates made of different materials have different coefficients of linear expansion or different anti-bending strength. Also, the semi-insulating GaAs substrate and the Si substrate disclosed in PTD 2 are provided as one substrate extending over the entire array antenna apparatus and having a relatively large area.

When two substrates having relatively large areas and made of different materials are joined to each other, these two substrates may undergo warpage, torsion or distortion due to the heat applied when joining two substrates or the heat emitted from the array antenna apparatus during use of this array antenna apparatus. This causes the positions of the plurality of antenna elements to deviate from the designed positions, so that the antenna characteristics of the array antenna apparatus deteriorate.

The first to third dielectric substrates disclosed in PTD 3 are provided as one substrate extending over the entire array antenna apparatus and having a relatively large area. Accordingly, when the first to third dielectric substrates are made of different materials in PTD 3, the positions of the plurality of antenna elements deviate from the designed positions also in PTD 3 for the same reason as that in PTD 2. Consequently, the antenna characteristics of the array antenna apparatus deteriorate.

In PTD 3, even if the first to third dielectric substrates are made of the same material, the first to third dielectric substrates may be provided with different electric elements or different wiring lines. The first to third dielectric substrates having different electric elements or different wiring patterns formed thereon may have different coefficients of linear expansion, different dynamic physical properties, or different geometrical symmetries. Accordingly, even if the first to third dielectric substrates are made of the same material in PTD 3, these first to third dielectric substrates may undergo warpage, torsion or distortion. Consequently, the positions of the plurality of antenna elements deviate from the designed positions, so that the antenna characteristics of the array antenna apparatus may deteriorate.

The present invention has been made in light of the above-described problems. An object of the present invention is to provide an array antenna apparatus that can be reduced in size and also can reduce the positional misalignment among a plurality of antenna elements so as to have excellent antenna characteristics, and a method of manufacturing the array antenna apparatus.

Solution to Problem

An array antenna apparatus of the present invention includes: a wiring substrate having a plurality of fed patch antennas and a plurality of active element circuits that are electrically connected to the plurality of fed patch antennas, respectively; and a plurality of antenna substrates having parasitic patch antennas, respectively. The plurality of antenna substrates are joined onto one wiring substrate.

A method of manufacturing an array antenna apparatus of the present invention includes: forming a wiring substrate; forming a plurality of antenna substrates; and joining the plurality of antenna substrates to one wiring substrate. The wiring substrate has a plurality of fed patch antennas and a plurality of active element circuits electrically connected to the plurality of fed patch antennas, respectively. Forming a plurality of antenna substrates includes providing at least one parasitic patch antenna.

Advantageous Effects of Invention

According to the present invention, it becomes possible to provide an array antenna apparatus that can be reduced in size and also can reduce the positional misalignment among the plurality of antenna elements so as to have excellent antenna characteristics as designed, and a method of manufacturing the array antenna apparatus.

DESCRIPTION OF EMBODIMENTS

The embodiments of the present invention will be hereinafter described with reference to the accompanying drawings.

First Embodiment

Figure 1:
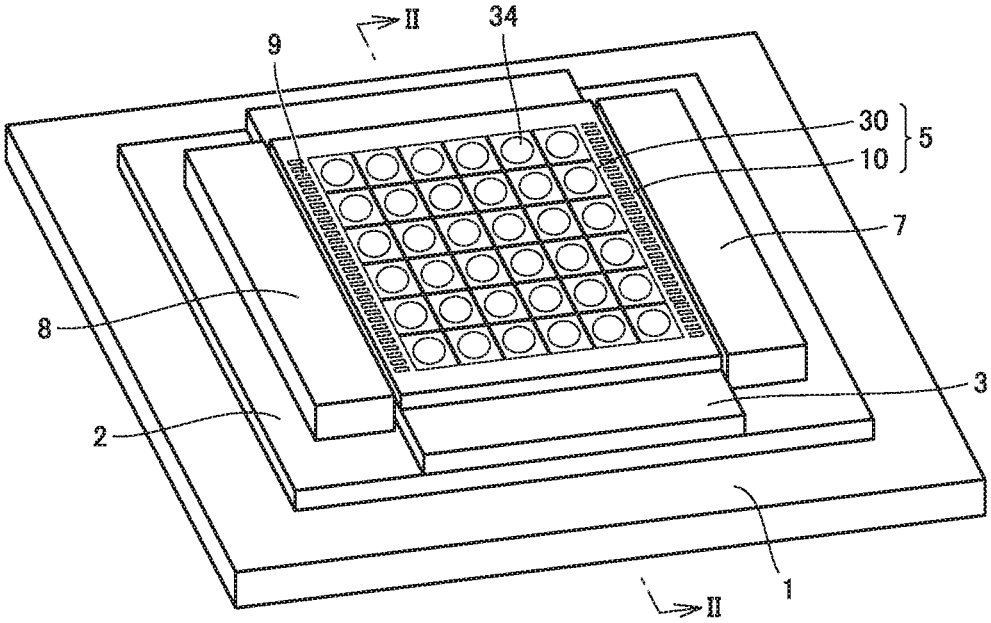
FIG. 1 is a schematic perspective view of an array antenna module according to the first embodiment of the present invention.
Figure 2:
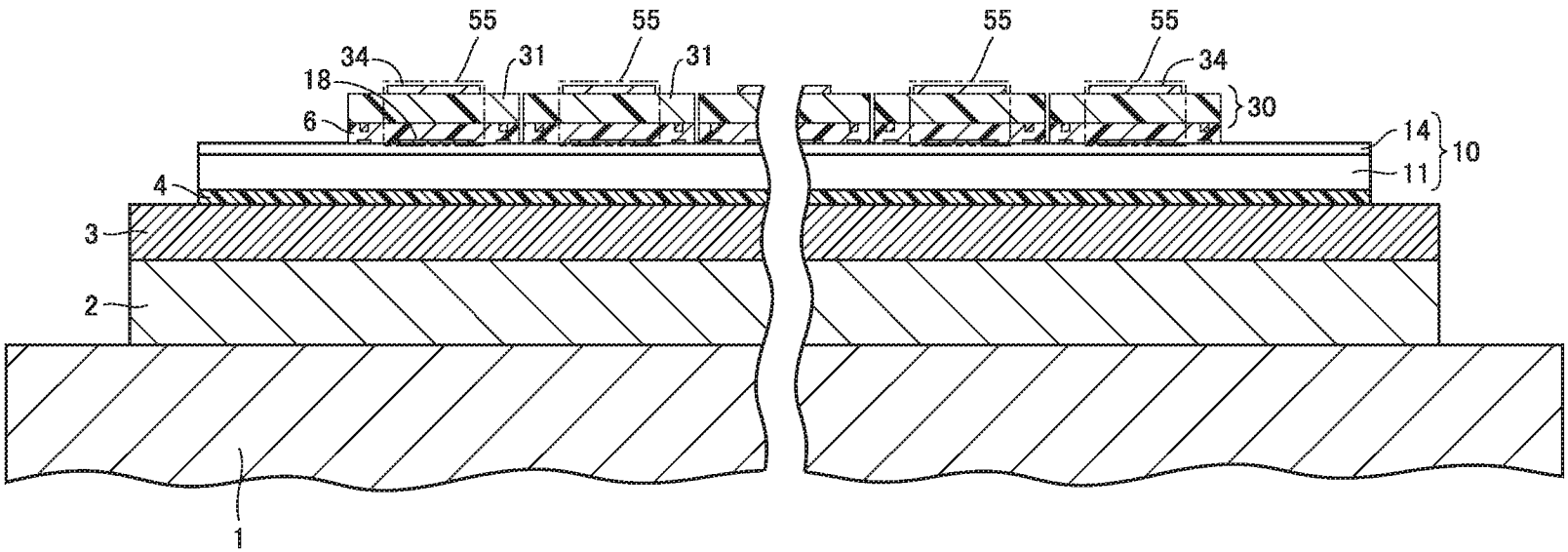
FIG. 2 is a schematic cross-sectional view of the array antenna module according to the first embodiment of the present invention, which is taken along a section line II-II shown in FIG. 1.

Referring to FIGS. 1 and 2, an antenna module of the present embodiment includes a housing 1, a base plate 2, a carrier 3, an array antenna apparatus 5, control substrates 7, 8, a pad 9, a wiring substrate 10, and an antenna substrate 30.

Housing 1 can be formed, for example, using a metal plate such as an aluminum alloy sheet.

Base plate 2 is fixed to housing 1, for example, using a fixing member such as a screw. Base plate 2 can be formed, for example, using a metal plate such as an aluminum alloy sheet.

Carrier 3 is fixed to base plate 2, for example, using a fixing member such as a screw. Carrier 3 can be formed, for example, using a metal plate such as a copper-tungsten plate (Cu—W plate). It is preferable that carrier 3 has approximately the same coefficient of linear expansion as that of wiring substrate 10.

Array antenna apparatus 5 mainly has a wiring substrate 10 and a plurality of antenna substrates 30. In array antenna apparatus 5 of the present embodiment, a plurality of antenna elements 55 are arranged on wiring substrate 10 in a one-dimensional array form or in a two-dimensional array form. It is described in the present specification that a plurality of antenna elements 55 are arranged in an array form, which means that a plurality of antenna elements 55 are arranged in a regular manner or in an irregular manner. In the present embodiment, the plurality of antenna elements 55 are arranged in a two-dimensional manner. More specifically, the plurality of antenna elements 55 are arranged in a square lattice form.

Antenna element 55 includes: one fed patch antenna 18; one parasitic patch antenna 34; and a second substrate 31 and an adhesive film 6 that are located in a region sandwiched between one fed patch antenna 18 and one parasitic patch antenna 34.

In the present embodiment, wiring substrate 10 is a single substrate. Wiring substrate 10 may be divided into a plurality of sub-wiring substrates. When wiring substrate 10 is divided into a plurality of sub-wiring substrates, a plurality of antenna substrates 30 are joined onto the plurality of sub-wiring substrates, respectively. Also, an outer periphery of each of the plurality of antenna substrates 30 in a plane orthogonal to the thickness direction of each of the plurality of antenna substrates 30 ("in a plane orthogonal to the thickness direction" may be hereinafter simply described as "in a plane") is smaller than an outer periphery of each of the plurality of sub-wiring substrates in a plane orthogonal to the thickness direction of each of the plurality of sub-wiring substrates.

Array antenna apparatus 5 is fixed on carrier 3. In the present embodiment, array antenna apparatus 5 is fixed on carrier 3 by adhesive layer 4.

Wiring substrate 10 is fixed on the surface of carrier 3 on the opposite side of the surface facing base plate 2. In the present embodiment, wiring substrate 10 is fixed by adhesive layer 4 onto the surface of carrier 3 on the opposite side of the surface facing base plate 2.

Each of the plurality of antenna substrates 30 has a parasitic patch antenna 34. Each of the plurality of antenna substrates 30 is joined onto the surface of wiring substrate 10 on the opposite side of the surface facing carrier 3. In the present embodiment, each of the plurality of antenna substrates 30 is fixed by adhesive film 6 onto the surface of wiring substrate 10 on the opposite side of the surface facing carrier 3.

Control substrates 7 and 8 are fixed on base plate 2, for example, using a fixing member such as a screw. Control substrates 7 and 8 each are located in the outer peripheral region of carrier 3. Control substrates 7 and 8 can be formed, for example, using a printed circuit board made of resin with low dielectric loss. Control substrates 7 and 8 each are provided for example with: a baseband signal processing circuit configured to demodulate a received signal for decoding or configured to encode a transmission signal for modulation; a control circuit configured to control a plurality of active element circuits 13 (see FIG. 4) for performing at least one of transmission or reception of electromagnetic waves; a power supply; and the like. Electric power is supplied through a connector (not shown) from control substrates 7 and 8 to the outside.

Wiring substrate 10 and control substrates 7, 8 are electrically connected, for example, using wires made of gold (Au), aluminum (Al) or the like. In the present embodiment, pad 9 provided on wiring substrate 10 and pads (not shown) provided on control substrates 7 and 8 are connected through a wire.

Figure 3:
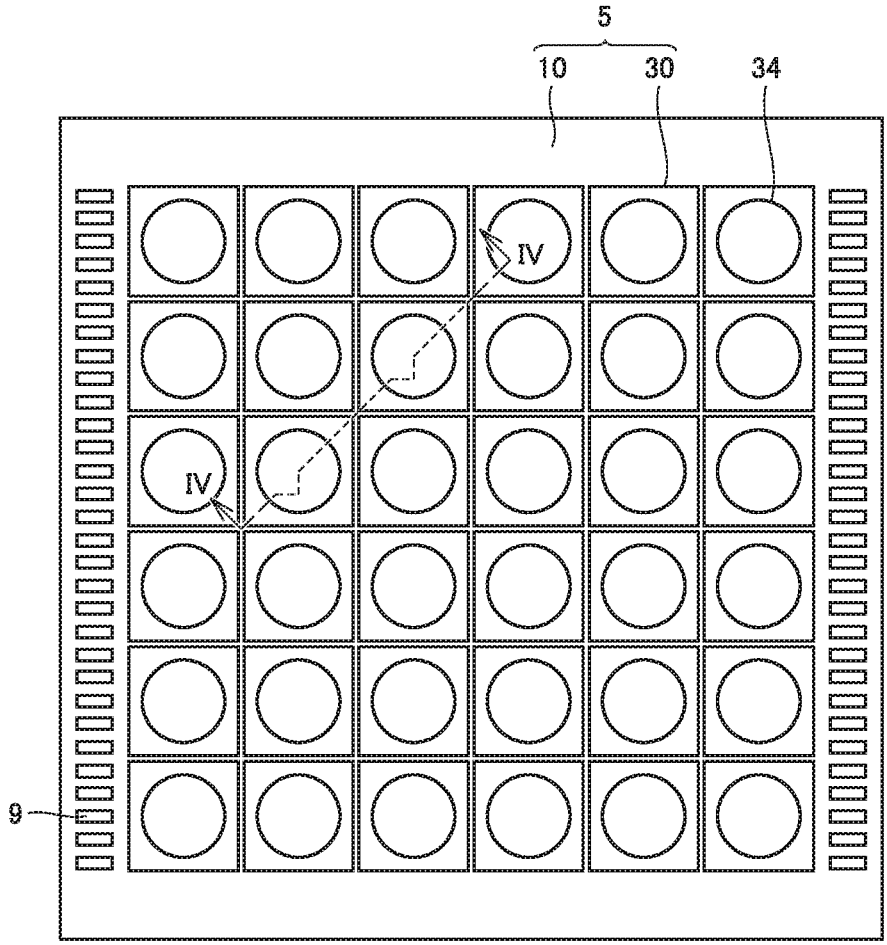
FIG. 3 is a schematic top view of an array antenna apparatus according to the first embodiment of the present invention.
Figure 4:
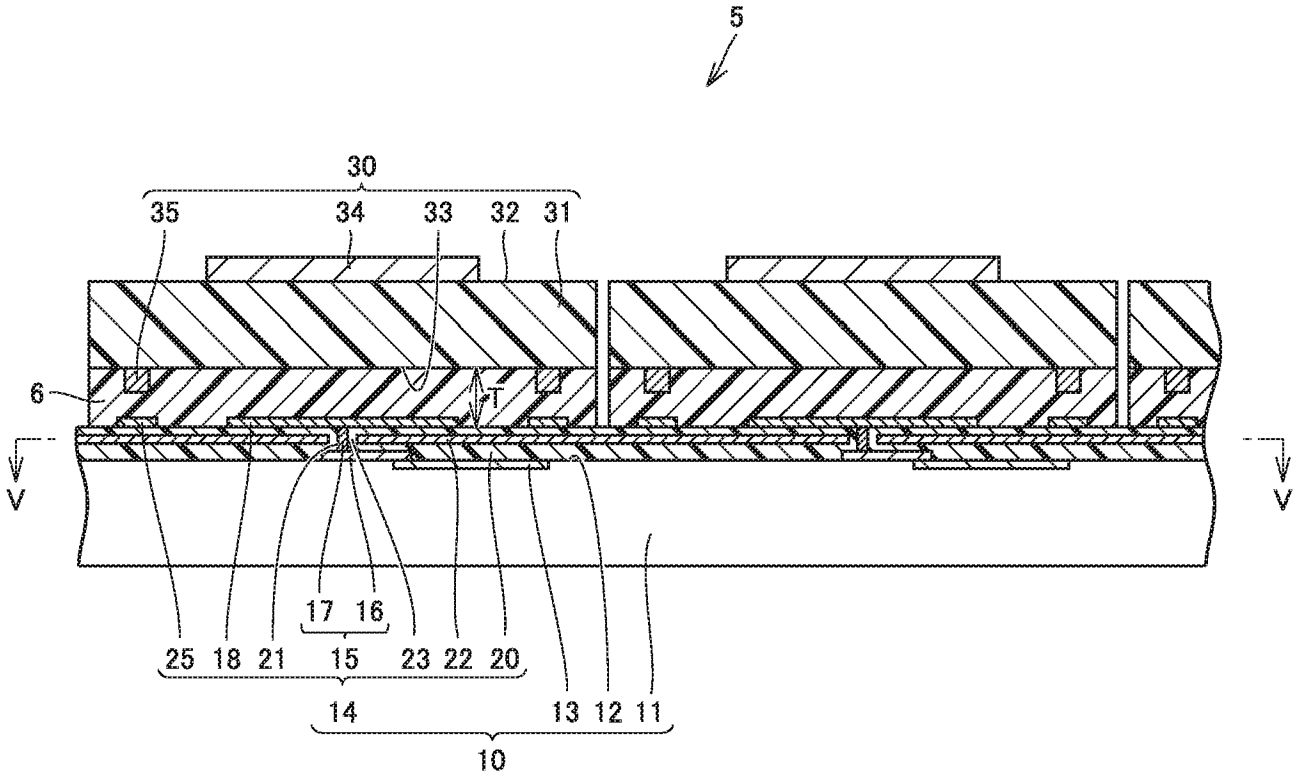
FIG. 4 is a schematic cross-sectional view of the array antenna apparatus according to the first embodiment of the present invention, which is taken along a section line IV-TV shown in FIG. 3.

Then, referring to FIGS. 3 to 5, the structure of array antenna apparatus 5 having wiring substrate 10 and antenna substrate 30 will be hereinafter described in detail.

First, wiring substrate 10 will be hereinafter described. In the present embodiment, wiring substrate 10 includes a first substrate 11 having a first surface 12, and a wiring layer 14.

The outer peripheral shape in a plane of each of wiring substrate 10 and first substrate 11 may be a polygon such as a triangle, quadrangle, a pentagon, or a hexagon, a circle, an ellipse, or the like. The outer peripheral shape in a plane of each of wiring substrate 10 and first substrate 11 may be a polygon such as a regular triangle, a square, or a regular hexagon, a circle, or the like. In the present embodiment, the outer peripheral shape in a plane of each of wiring substrate 10 and first substrate 11 is a square.

First substrate 11 can be made using a semiconductor substrate including a semi-insulating semiconductor substrate. First substrate 11 can be made using an Si substrate, an SiGe substrate, a GaAs substrate, an InP substrate, a GaSb substrate, an SiC substrate, a GaN substrate, and the like. In the present embodiment, first substrate 11 is made using an SiGe substrate obtained by adding a small amount of germanium to a substrate made of silicon as a main component. As in the present embodiment, active element circuit 13 formed on the SiGe substrate consumes less power, operates at high speed, and produces less noise. This allows high speed processing of a large capacity of data that is transmitted or received via high-frequency electromagnetic waves such as a microwave and a millimeter wave, so that the antenna characteristics of array antenna apparatus 5 can be improved.

When a semiconductor substrate is used as first substrate 11 as in the present embodiment, using a semiconductor processing process, at least some of signal processing circuits such as a baseband signal processing circuit provided on control substrates 7 and 8 can be formed on first substrate 11, in addition to a plurality of active element circuits 13 configured to perform at least one of transmission or reception of electromagnetic waves. The plurality of active element circuits 13 configured to perform at least one of transmission or reception of electromagnetic waves and the signal processing circuits are integrated on first substrate 11, so that some of the circuits that are to be provided on control substrates 7 and 8 can be arranged on first substrate 11. Accordingly, control substrates 7 and 8 can be reduced in size, so that the resultant array antenna module can be reduced in size.

When the plurality of active element circuits 13 configured to perform at least one of transmission or reception of electromagnetic waves and the signal processing circuits are integrated on first substrate 11, the path between the plurality of active element circuits 13 and the signal processing circuits can be reduced in length. Accordingly, transmission loss of the high-frequency electromagnetic waves such as a microwave and a millimeter wave in array antenna apparatus 5 can be reduced. Also, a large capacity of data transmitted or received via the high-frequency electromagnetic waves such as a microwave and a millimeter wave can be processed at high speed.

When the plurality of active element circuits 13 and the signal processing circuits are integrated on first substrate 11, it becomes possible to suppress positional misalignment between the plurality of active element circuits 13 and the signal processing circuits, as compared with the case where one substrate on which a plurality of active element circuits 13 for performing at least one of transmission or reception of electromagnetic waves are formed is joined to another substrate on which the signal processing circuits are formed. Therefore, according to array antenna apparatus 5 in which a plurality of active element circuits 13 for performing at least one of transmission or reception of electromagnetic waves and the signal processing circuits are integrated on first substrate 11, it becomes possible to reduce transmission loss of the high-frequency electromagnetic waves such as a microwave and a millimeter wave, and also possible to reduce noise generation.

First substrate 11 has a first surface 12. First surface 12 may be a flat surface or may be a curved surface such as a spherical surface. In the present embodiment, first surface 12 is a flat surface.

First substrate 11 may be a semiconductor wafer. The diameter of first substrate 11 may be 1 cm or more, preferably 2.5 cm or more and 30 cm or less, and more preferably 5 cm or more and 20 cm or less.

First substrate 11 has a plurality of active element circuits 13 configured to perform at least one of transmission or reception of electromagnetic waves. Each of the plurality of active element circuits 13 can include, for example, a high-frequency electric element configured to perform at least one of transmission or reception of electromagnetic waves such as a microwave and a millimeter wave. The high-frequency electric element configured to perform at least one of transmission and reception of electromagnetic waves such as a microwave and a millimeter wave may include, for example, at least one of a low noise amplifier (LNA), a high power amplifier (IPA), and a phase shifter (PS).

In the present embodiment, a plurality of active element circuits 13 for performing at least one of transmission or reception of electromagnetic waves are provided on first surface 12 of first substrate 11. The plurality of active element circuits 13 can be formed on first surface 12 of first substrate 11, for example, by using a semiconductor processing process.

Wiring layer 14 has a plurality of fed patch antennas 18 and an electrical connection 15. In the present embodiment, wiring layer 14 has an electrical connection 15, a plurality of fed patch antennas 18, an insulating layer 20, a ground conductor layer 22, and a first alignment mark 25. Electrical connection 15 has a first electrical connection portion 16 and a second electrical connection portion 17.

In the present embodiment, wiring layer 14 can be provided on first surface 12 of first substrate 11. Wiring layer 14 is provided integrally on first substrate 11. The surface of wiring layer 14 on the opposite side of first substrate 11 is a surface to which the plurality of antenna substrates 30 are joined. The surface of wiring layer 14 on the opposite side of first substrate 11 may be a flat surface or may be a curved surface such as a spherical surface. In the present embodiment, the surface of wiring layer 14 on the opposite side of first substrate 11 is a flat surface.

Electrical connection 15 electrically connects the plurality of active element circuits 13 for performing at least one of transmission or reception of electromagnetic waves and the plurality of fed patch antennas 18, respectively. In the present embodiment, electrical connection 15 includes a first electrical connection portion 16 and a second electrical connection portion 17.

First electrical connection portion 16 is provided on first surface 12 of first substrate 11. First electrical connection portion 16 may be a conductor layer. First electrical connection portion 16 is made of a conductive material such as gold (Au) or copper (Cu). In the present embodiment, first electrical connection portion 16 is a copper layer.

Second electrical connection portion 17 electrically connects first electrical connection portion 16 and a corresponding one of the plurality of fed patch antennas 18. Second electrical connection portion 17 may be formed using a through conductor. The through conductor can be formed by filling a via hole 21 provided in insulating layer 20 with a conductive material. The through conductor may be formed of a conductive material such as gold (Au) or copper (Cu).

Second electrical connection portion 17 may be provided as a slot. When a slot is used as second electrical connection portion 17, first electrical connection portion 16 and fed patch antenna 18 are electromagnetically coupled to each other through the slot.

It is desirable that second electrical connection portion 17 is arranged at a position displaced from the center of fed patch antenna 18. In the present embodiment, second electrical connection portion 17 is arranged at a position displaced from the center of fed patch antenna 18 (see FIG. 5).

When wiring layer 14 having electrical connection 15 is provided, electrical connection 15 can be routed from the plurality of active element circuits 13 provided on first surface 12 of first substrate 11 to arbitrary positions. Thus, it becomes possible to freely design the positions at which the plurality of active element circuits 13 are arranged relative to the plurality of fed patch antennas 18, respectively. Furthermore, a passive element such as fed patch antenna 18 having an area relatively larger than that of active element circuit 13 can be formed integrally with first substrate 11 having active element circuit 13 formed thereon.

Insulating layer 20 is disposed on first surface 12 of first substrate 11. At least a part of electrical connection 15 is embedded in insulating layer 20. At least a part of electrical connection 15 is disposed inside insulating layer 20. In the present embodiment, at least a part of second electrical connection portion 17 is embedded in insulating layer 20. At least a part of second electrical connection portion 17 is disposed inside insulating layer 20. Furthermore, at least a part of ground conductor layer 22 is embedded in insulating layer 20. At least a part of ground conductor layer 22 is disposed inside insulating layer 20.

Insulating layer 20 may contain resin. The resin used for insulating layer 20 may have thermoplastic properties or thermosetting properties. The resin used for insulating layer 20 preferably has excellent machine strength, excellent heat resistance and less dielectric loss (a small dielectric loss tangent). In the present embodiment, insulating layer 20 mainly contains thermoplastic polyimide.

The plurality of fed patch antennas 18 are provided on wiring substrate 10 (first substrate 11). In the present embodiment, the plurality of fed patch antennas 18 are provided on the surface of insulating layer 20 on the opposite side of first substrate 11. The plurality of active element circuits 13 for performing at least one of transmission or reception of electromagnetic waves and the plurality of fed patch antennas 18 are provided on first substrate 11. The path between the plurality of active element circuits 13 and the plurality of fed patch antennas 18 can be reduced in length. Accordingly, transmission loss of the high-frequency electromagnetic waves such as a microwave and a millimeter wave in array antenna apparatus 5 can be reduced. Also, a large capacity of data transmitted or received via the high-frequency electromagnetic waves such as a microwave and a millimeter wave can be processed at high speed.

In the present embodiment, the plurality of active element circuits 13 for performing at least one of transmission or reception of electromagnetic waves and the plurality of fed patch antennas 18 are integrally provided on first substrate 11. Accordingly, as compared with a comparative example in which one substrate on which a plurality of active element circuits 13 for performing at least one of transmission or reception of electromagnetic waves are formed is joined to another substrate on which a plurality of fed patch antennas 18 are formed, the present embodiment can suppress occurrence of positional misalignment between the plurality of active element circuits 13 and the plurality of fed patch antennas 18. Consequently, according to array antenna apparatus 5 of the present embodiment, it becomes possible to reduce transmission loss of the high-frequency electromagnetic waves such as a microwave and a millimeter wave, and also possible to suppress generation of electromagnetic-wave noise.

The plurality of fed patch antennas 18 are provided on wiring substrate 10 (first substrate 11) in a one-dimensional array form or in a two-dimensional array form. In the present embodiment, the plurality of fed patch antennas 18 are provided on wiring substrate 10 (first substrate 11) at a pitch P in a two-dimensional array form (see FIG. 5).

The plurality of fed patch antennas 18 each are made of a conductive material such as gold (Au) or copper (Cu). In the present embodiment, fed patch antennas 18 each are made of copper (Cu). As to fed patch antennas 18, for example, copper foil may be formed on the surface of insulating layer 20 of wiring layer 14 and etched so as to collectively form a plurality of fed patch antennas 18.

The outer peripheral shape in a plane of each of the plurality of fed patch antennas 18 may be a polygon such as a triangle, a quadrangle, a pentagon, or a hexagon, a circle, an ellipse, concentric circles arranged in ring shapes, or the like. The outer peripheral shape in a plane of each of the plurality of fed patch antennas 18 may be a regular polygon such as a regular triangle, a square, a regular pentagon, or a regular hexagon, a circle, or the like. In the present embodiment, the outer peripheral shape in a plane of the each of the plurality of fed patch antennas 18 is a circular shape.

Ground conductor layer 22 is provided between the plurality of active element circuits 13 and the plurality of fed patch antennas 18. Accordingly, the electromagnetic-wave noise generated in the plurality of active element circuits 13 is shielded by ground conductor layer 22, and therefore, not coupled to the plurality of fed patch antennas 18. Consequently, a plurality of antenna elements 55 and array antenna apparatus 5 with excellent antenna performance can be achieved.

Ground conductor layer 22 is provided on wiring layer 14 such that this ground conductor layer 22 is electrically insulated from at least a part of electrical connection 15 and the plurality of fed patch antennas 18. In the present embodiment, ground conductor layer 22 is electrically insulated by insulating layer 20 from the plurality of fed patch antennas 18 and second electrical connection portion 17. In order to electrically insulate ground conductor layer 22 from second electrical connection portion 17, ground conductor layer 22 is provided with an opening 23 in which second electrical connection portion 17 is provided.

If the size of opening 23 is too large, electromagnetic-wave noise generated from the plurality of active element circuits 13 and the like may flow directly into second electrical connection portion 17 or fed patch antenna 18, thereby deteriorating the antenna characteristics of array antenna apparatus 5. Accordingly, the gap between second electrical connection portion 17 as a through electrode and opening 23 of ground conductor layer 22 is preferably equal to or less than ¼ of a wavelength λ of the electromagnetic waves transmitted from or received by array antenna apparatus 5 (equal to or less than λ/4), and more preferably, equal to or less than ⅛ (equal to or less than λ/8).

In the present embodiment, ground conductor layer 22 is further electrically insulated by insulating layer 20 also from the plurality of active element circuits 13. Ground conductor layer 22 may be made of a conductive material such as gold (Au) or copper (Cu).

In the comparative example in which ground conductor layer 22 is minutely divided like antenna substrate 30, noise and the like generated from the plurality of active element circuits 13 and the like may flow from the gap between the divided ground conductor layers into fed patch antenna 18, so that the antenna characteristics of array antenna apparatus 5 may deteriorate.

Figure 5:
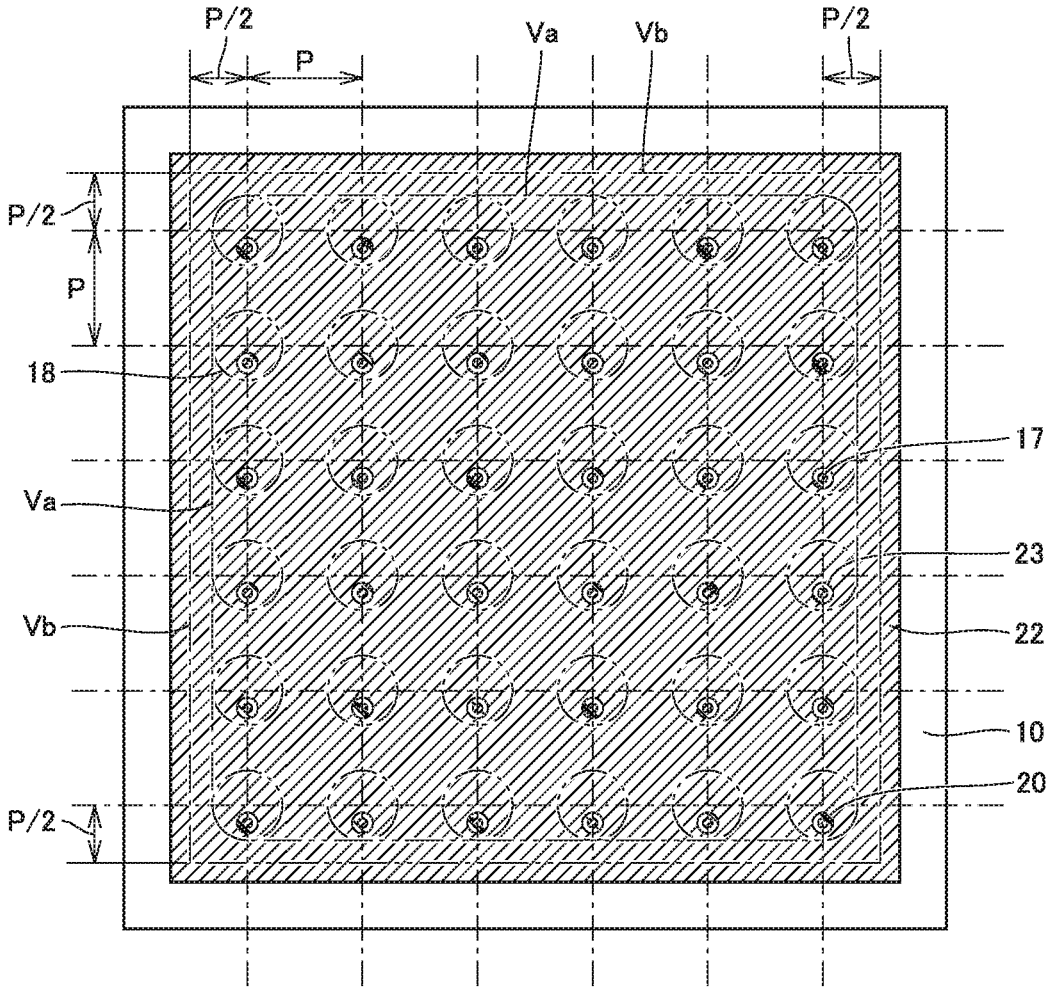
FIG. 5 is a schematic cross-sectional view of the array antenna apparatus according to the first embodiment of the present invention, which is taken along a section line V-V shown in FIG. 4.
Figure 6A:
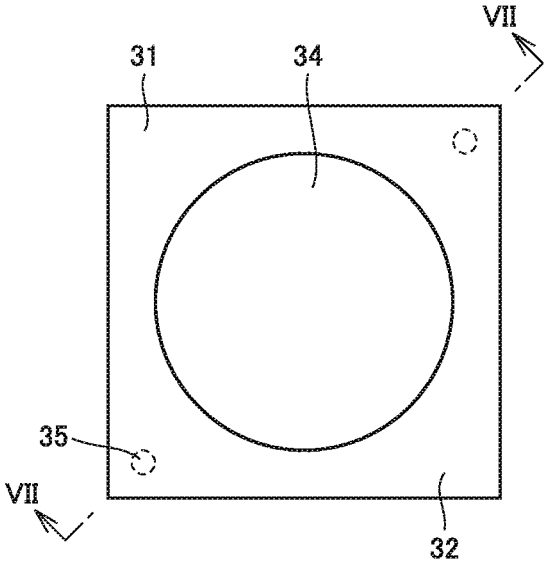
FIG. 6(A) is a schematic top view of an antenna substrate of the array antenna apparatus according to the first embodiment of the present invention.
Figure 6B:
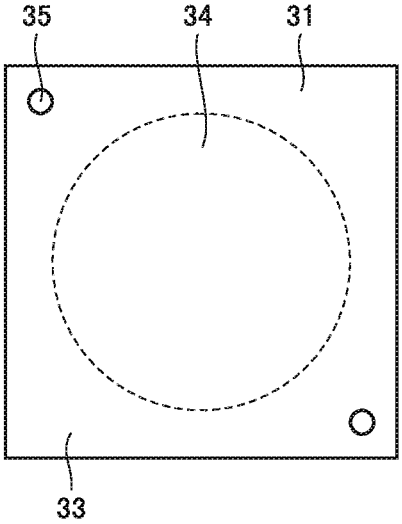
FIG. 6(B) is a schematic bottom view of the antenna substrate of the array antenna apparatus according to the first embodiment of the present invention.
Figure 7:
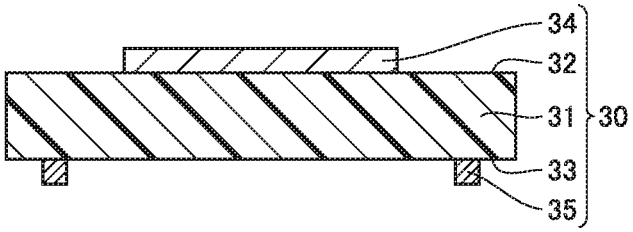
FIG. 7 is a schematic cross-sectional view of the antenna substrate of the array antenna apparatus according to the first embodiment of the present invention, which is taken along a section line VII-VII shown in FIG. 6A.

On the other hand, in the present embodiment, ground conductor layer 22 has one conductor layer extending in a region larger than the outer peripheral region of the plurality of fed patch antennas 18 (a region surrounded by a line Va in FIG. 5). As in the above-described comparative example, in the present embodiment, the electromagnetic-wave noise generated from the plurality of active element circuits 13 and the like can be suppressed from flowing through the gap between the divided ground conductor layers into fed patch antenna 18. Accordingly, array antenna apparatus 5 of the present embodiment has excellent antenna characteristics. Ground conductor layer 22 preferably has one conductor layer extending from the center of fed patch antenna 18 provided on the outermost side of wiring substrate 10 across a region larger than a region extending in the outward direction by a distance of half of pitch P on each of the plurality of fed patch antennas 18 (a region surrounded by a line Yb in FIG. 5). In addition, ground conductor layer 22 also may extend to the outer periphery of wiring substrate 10.

Wiring substrate 10 may be provided with a plurality of first alignment marks 25 used for aligning wiring substrate 10 and antenna substrate 30 with each other. The plurality of first alignment marks 25 may be provided on wiring layer 14. In the present embodiment, first alignment mark 25 is provided on the surface of insulating layer 20 on the opposite side of first substrate 11.

First alignment mark 25 is required only when antenna substrate 30 is aligned with wiring substrate 10, and does not contribute to the function as an antenna. It is desirable that first alignment mark 25 is small in size in order to prevent first alignment mark 25 from exerting an electromagnetic influence upon array antenna apparatus 5 during the operation of array antenna apparatus 5. Accordingly, it is preferable that the diameter of first alignment mark 25 is 0.1 mm or less.

First alignment mark 25 may be made of a material such as gold (Au) or copper (Cu). In the present embodiment, first alignment mark 25 is made of copper (Cu).

First alignment mark 25 may be formed by patterning the conductor provided on insulating layer 20. When forming electrical connection 15 provided in insulating layer 20 or forming fed patch antenna 18, first alignment mark 25 may be formed collectively with electrical connection 15 or fed patch antenna 18. For example, a conductor such as copper formed on the surface of insulating layer 20 on the opposite side of first substrate 11 may be etched to collectively form fed patch antenna 18 and first alignment mark 25.

Then, referring to FIGS. 4 and 6 to 9, antenna substrate 30 will be hereinafter described.

In the present embodiment, antenna substrate 30 includes: a second substrate 31 having a second surface 32 and a third surface 33 on the opposite side of second surface 32; and a parasitic patch antenna 34. Antenna substrate 30 may further include a second alignment mark 35.

The outer peripheral shape in a plane of each of antenna substrate 30 and second substrate 31 may be a polygon such as a triangle, a quadrangle, a pentagon, or a hexagon, a circle, an ellipse, a ring shape, or the like. The outer peripheral shape in a plane of each of antenna substrate 30 and second substrate 31 may be a regular polygon such as a regular triangle, a square, a regular pentagon, or a regular hexagon, a circle, or the like. In the present embodiment, the outer peripheral shape in a plane of each of antenna substrate 30 and second substrate 31 is a square shape.

The outer periphery in a plane of antenna substrate 30 is smaller than the outer periphery of wiling substrate 10 or the outer periphery of first substrate 11. For example, when the outer peripheral shape in a plane of antenna substrate 30 is a polygon, the length of one side of antenna substrate 30 is shorter than the length of one side of wiring substrate 10 or first substrate 11. The length of one side of antenna substrate 30 may be equal to or less than half of the length of one side of wiring substrate 10 or first substrate 11. For example, when the outer peripheral shape in a plane of antenna substrate 30 is a circle, the diameter of antenna substrate 30 is smaller than the diameter of wiring substrate 10 or first substrate 11. The diameter of antenna substrate 30 may be equal to or less than half of the diameter of wiring substrate 10 or first substrate 11. For example, when the outer peripheral shape in a plane of antenna substrate 30 is an ellipse, the major axis and the minor axis of antenna substrate 30 are smaller than the major axis and the minor axis, respectively, of wiring substrate 10 or first substrate 11. The major axis and the minor axis of antenna substrate 30 may be equal to or less than half of the major axis and the minor axis, respectively, of wiring substrate 10 or first substrate 11. Referring to FIG. 1, in the present embodiment, the length of one side of antenna substrate 30 is equal to or less than ⅙ of the length of one side of wiring substrate 10 or first substrate 11.

Second substrate 31 can be formed, for example, using a high-frequency printed circuit board, a liquid crystal polymer substrate, and a ceramic substrate such as a low temperature co-fired ceramics (LTCC) substrate. In order to reduce transmission delay and transmission loss of high-frequency electromagnetic waves such as a microwave and a millimeter wave, it is preferable that second substrate 31 is a high-frequency printed circuit board made of a fluororesin-based material such as polytetrafluoroethylene (PTFE), which exhibits a low dielectric constant and low dielectric loss. In the present embodiment, second substrate 31 is made using a fluororesin-based high-frequency printed circuit board.

It is preferable that second substrate 31 is made using a substrate having a small dielectric loss tangent (tan δ) in order to reduce the dielectric loss in second substrate 31. Second substrate 31 is preferably a high-frequency printed circuit board having a dielectric loss tangent (tan δ) of 0.003 or less, and more preferably, a high-frequency printed circuit board having a dielectric loss tangent (tan δ) of 0.001 or less. When a high-frequency printed circuit board is used as second substrate 31, it is preferable that the low dielectric loss of the base material itself of the high-frequency printed circuit board is kept as much as possible by reducing the amount of glass fibers and other additives as low as possible In the present embodiment, second substrate 31 is made using a fluororesin-based, double-sided copper-clad printed circuit board as one of high-frequency printed circuit boards. The double-sided copper-clad printed circuit board has: a base material obtained by stacking an insulating fluororesin and a woven fabric of glass fibers; and copper foil. The coefficient of linear expansion in a plane of the double-sided copper-clad printed circuit board is given by the coefficient of linear expansion of copper of 16.5 ppm/° C. in the double-sided copper-clad printed circuit board.

It is preferable that the thickness of antenna substrate 30 (second substrate 31) defined by the distance between second surface 32 and third surface 33 is 100 μm or more and 1 mm or less. When the thickness of antenna substrate 30 is set at 100 μm or more, it becomes possible to suppress coupling of electromagnetic waves that are not required for parasitic patch antenna 34. Accordingly, it becomes possible to obtain antenna element 55 and array antenna apparatus 5 exhibiting high radiation efficiency and a wide frequency bandwidth of available electromagnetic waves. When the thickness of antenna substrate 30 is set to be 1 mm or less, the double-sided printed circuit board having copper foil formed on second surface 32 and third surface 33 is subjected to cut-out processing, so that antenna substrate 30 can be obtained. Accordingly, the outer shape of antenna substrate 30 can be precisely adjusted, so that the antenna characteristics of the plurality of antenna elements 55 can be rendered uniform. Also, a plurality of antenna substrates 30 can be manufactured with efficiency at low cost. In the present embodiment, the thickness of antenna substrate 30 (second substrate 31) is 130 μm.

Parasitic patch antenna 34 is provided on second substrate 31. In the present embodiment, parasitic patch antenna 34 is provided on second surface 32 of second substrate 31. Parasitic patch antenna 34 is provided on the entirety or a part of second surface 32 of second substrate 31. In the present embodiment, parasitic patch antenna 34 is formed on a part of second surface 32 of antenna substrate 30 (second substrate 31).

Parasitic patch antenna 34 is provided so as to correspond to a corresponding one of the plurality of fed patch antennas 18. Parasitic patch antenna 34 is not connected by electrical connection 15 to a corresponding one of the plurality of active element circuits 13 provided on first substrate 11. Parasitic patch antenna 34 is electromagnetically coupled to fed patch antenna 18. Accordingly, parasitic patch antenna 34 functions as a part of antenna element 55. By such parasitic patch antenna 34, antenna element 55 and array antenna apparatus 5 having a wide bandwidth can be obtained.

Parasitic patch antenna 34 may be made of a conductive material such as gold (Au) or copper (Cu). In the present embodiment, parasitic patch antenna 34 is made of copper (Cu).

The outer peripheral shape in a plane of parasitic patch antenna 34 may be a polygon such as a triangle, a quadrangle, a pentagon, or a hexagon, a circle, an ellipse, concentric circles arranged in ring shapes, or the like. The outer peripheral shape in a plane of parasitic patch antenna 34 may be a regular polygon such as a regular triangle, a square, a regular pentagon, or a regular hexagon, a circle, or the like, in the present embodiment, the outer peripheral shape in a plane of parasitic patch antenna 34 is a circle.

Pitch P between fed patch antennas 18 adjacent to each other and pitch P between parasitic patch antennas 34 adjacent to each other are determined by the frequency of the electromagnetic waves transmitted from or received by array antenna apparatus 5, and by the values of the electrical properties of the materials forming array antenna apparatus 5. Thus, when parasitic patch antennas 34 are arranged at pitch P determined by the frequency of the transmitted or received electromagnetic waves and the materials forming array antenna apparatus 5, it becomes possible to arbitrarily set the number of parasitic patch antennas 34 formed in one antenna substrate 30, the size of antenna substrate 30, and the shape of antenna substrate 30, as long as the positional misalignment among the plurality of antenna elements 55 falls within a tolerable range. One parasitic patch antenna 34 may be formed on one antenna substrate 30 (see FIG. 8(A)). Alternatively, assuming that a plurality of parasitic patch antennas 34 are defined as one unit, the plurality of parasitic patch antennas 34 forming one unit may be formed on one antenna substrate 30 (see FIGS. 8(B) and 8(C)).

Figure 8A:
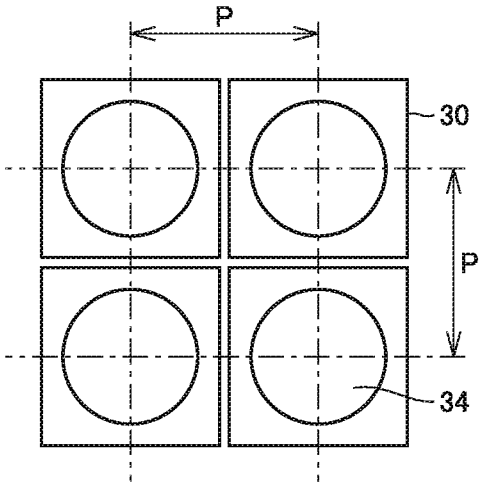
FIG. 8(A) is a schematic top view of a plurality of antenna substrates of the array antenna apparatus according to the first embodiment of the present invention.
Figure 8B:
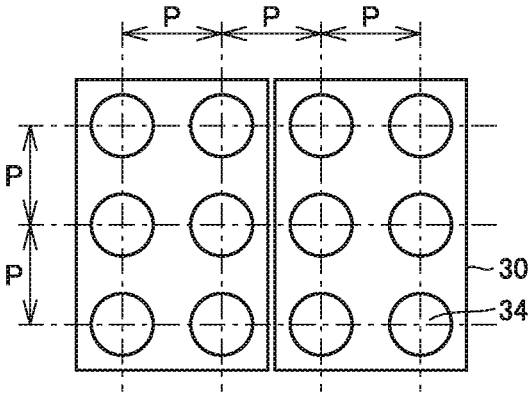
FIG. 8(B) is a schematic top view of a plurality of antenna substrates of an array antenna apparatus according to a modification of the first embodiment of the present invention.
Figure 8C:
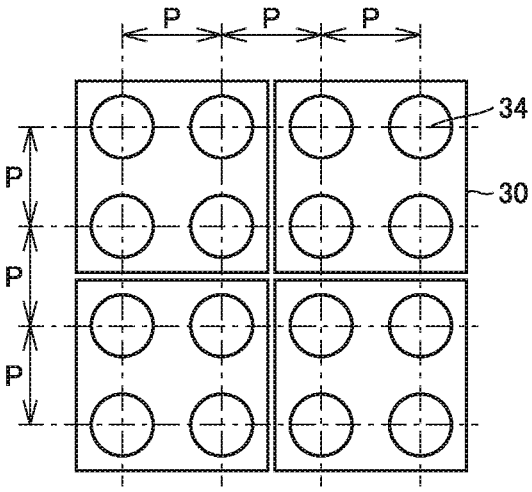
FIG. 8(C) is a schematic top view of a plurality of antenna substrates of an array antenna apparatus according to another modification of the first embodiment of the present invention.

In the present embodiment, as shown in FIG. 8(A), one parasitic patch antenna 34 is provided in one antenna substrate 30. Accordingly, one antenna element 55 is to be included in one antenna substrate 30. In a modification shown in FIG. 8(B), the outer periphery of antenna substrate 30 has a rectangular shape, and six parasitic patch antennas 34 are provided in one antenna substrate 30. Accordingly, six antenna elements 55 are included in one antenna substrate 30. In another modification shown in FIG. 8(C), the outer periphery of antenna substrate 30 has a square shape, and four parasitic patch antennas 34 are provided in one antenna substrate 30. Thus, four antenna elements 55 are included in one antenna substrate 30.

Antenna substrate 30 may be provided with a plurality of second alignment marks 35 used for aligning wiring substrate 10 and antenna substrate 30 with each other. The plurality of second alignment marks 35 may be provided on third surface 33 of second substrate 31. In the present embodiment, a pair of second alignment marks 35 are provided at a pair of corner portions on a diagonal line of third surface 33 of second substrate 31.

Second alignment mark 35 is required only when antenna substrate 30 is aligned with wiring substrate 10, and does not contribute to the function as an antenna. It is desirable that second alignment mark 35 is small in size in order to prevent second alignment mark 35 from exerting an electromagnetic influence upon array antenna apparatus 5 during the operation of array antenna apparatus 5. Accordingly, it is preferable that the diameter of second alignment mark 35 is 0.1 mm or less.

Second alignment mark 35 may be made of a material such as gold (Au) or copper (Cu). In the present embodiment, second alignment mark 35 is made of copper (Cu).

Antenna substrate 30 in the present embodiment can be manufactured, for example, by the method described below. First, a fluororesin-based, double-sided copper-clad printed circuit board is prepared that has a second surface 32 and a third surface 33 each having copper foil formed thereon. The copper foil formed on second surface 32 is etched to thereby form a plurality of parasitic patch antennas 34. The copper foil formed on third surface 33 is etched to thereby form a plurality of second alignment marks 35. Lastly, the double-sided printed circuit board on which a plurality of parasitic patch antennas 34 and a plurality of second alignment marks 35 are formed is subjected to cut-out processing, thereby producing a plurality of antenna substrates 30. Accordingly, the outer shape of antenna substrate 30 (second substrate 31) can be precisely adjusted, so that the antenna characteristics of the plurality of antenna elements 55 can be rendered uniform. Also, the plurality of antenna substrates 30 can be manufactured with efficiency at low cost.

In the present embodiment, antenna substrate 30 is aligned with wiring substrate 10 using the plurality of first alignment marks 25 and the plurality of second alignment marks 35. For example, each of the plurality of antenna substrates 30 may be aligned with one wiring substrate 10 such that the center of each of the plurality of fed patch antennas 18 and the center of each of parasitic patch antennas 34 are located to correspond to each other. The plurality of first alignment marks 25 and the plurality of second alignment marks 35 are used, so that antenna substrate 30 can be aligned accurately in a plane of wiring substrate 10. Thus, antenna element 55 and array antenna apparatus 5 each exhibiting high performance can be obtained.

The following steps may be performed for aligning wiring substrate 10 (first substrate 11) and the plurality of antenna substrates 30 (second substrates 31) with each other. Observation means such as a camera is used to determine the center position of each of the plurality of fed patch antennas 18 and the center position of the parasitic patch antenna 34 on each of the plurality of antenna substrates 30. Then, the plurality of antenna substrates 30 are aligned with wiring substrate 10 such that the center position of each of fed patch antennas 18 and the center position of each of parasitic patch antennas 34 are located to correspond to each other. In the above-described modification regarding this alignment, a plurality of antenna substrates 30 (second substrates 31) are aligned with wiring substrate 10 (first substrate 11) without using first alignment mark 25 and second alignment mark 35. Thus, in this modification, since the step of forming first alignment mark 25 and second alignment mark 35 can be eliminated, the manufacturing process can be simplified. Also in this modification, even if parasitic patch antenna 34 is formed on the entire second surface 32 of antenna substrate 30 (second substrate 31), alignment between wiring substrate 10 (first substrate 11) and the plurality of antenna substrates 30 (second substrates 31) can be accurately performed. Therefore, according to this modification, the design flexibility for parasitic patch antenna 34 can be improved.

Figure 9:
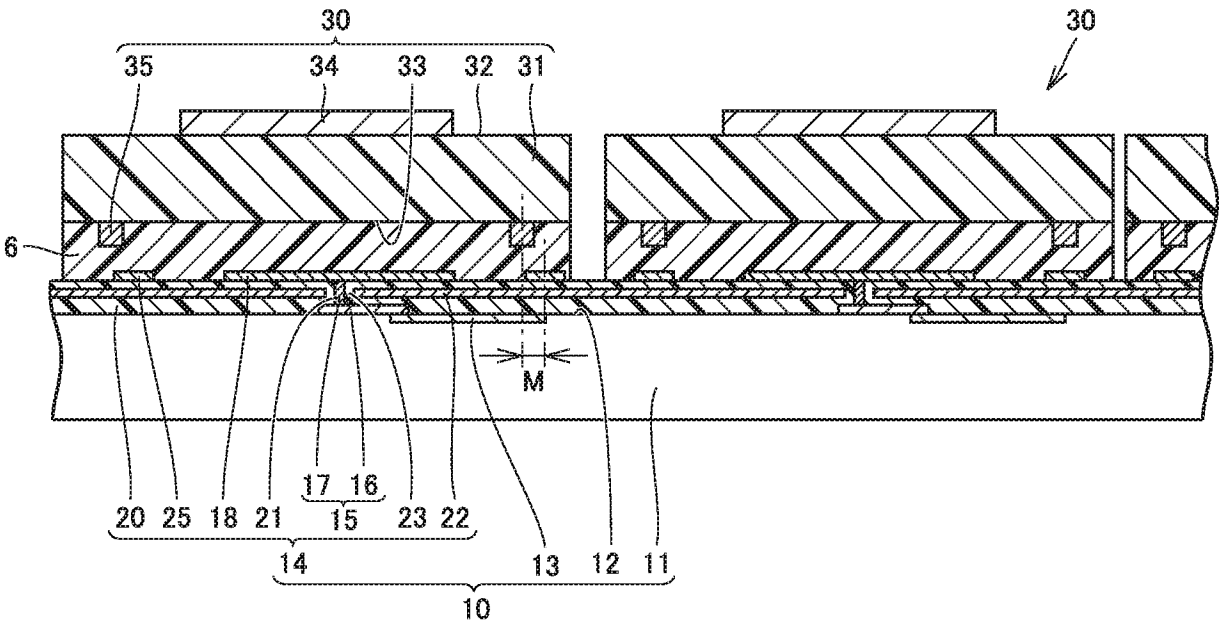
FIG. 9 is a schematic cross-sectional view of the array antenna apparatus according to the first embodiment of the present invention.

Referring to FIG. 9, when the position of antenna substrate 30 deviates in the in-plane direction of wiring substrate 10, the antenna characteristics of array antenna apparatus 5 deteriorate. As a result of the electromagnetic field simulation, a positional misalignment amount M in the in-plane direction of antenna substrate 30 relative to wiring substrate 10 is preferably 50 μm or less and further more preferably 20 μm or less. In the present embodiment, antenna substrate 30 is aligned with wiring substrate 10 using a plurality of first alignment marks 25 and a plurality of second alignment marks 35. Accordingly, positional misalignment amount M in the in-plane direction of antenna substrate 30 can be set to fall within 20 μm or less.

A plurality of antenna substrates 30 are joined onto one wiring substrate 10 to thereby obtain array antenna apparatus 5. The plurality of antenna substrates 30 are arranged on wiring substrate 10 in a tiled manner, to obtain array antenna apparatus 5. A plurality of parasitic patch antennas 34 are arranged at pitch P. In the present embodiment, a plurality of antenna substrates 30 are joined onto wiring substrate 10 at pitch P in each of two directions orthogonal to each other in a plane of wiring substrate 10 (see FIG. 5). Thus, the plurality of parasitic patch antennas 34 are also arranged at pitch P in each of two directions orthogonal to each other in a plane of wiring substrate 10, in addition, a plurality of parasitic patch antennas 34 and a plurality of antenna substrates 30 may be arranged at different pitches P in two different directions in a plane of wiring substrate 10.

The plurality of antenna substrates 30 are joined onto one wiring substrate 10 by a joining layer such as an adhesive film or a double-sided adhesion sheet that can be bonded at a room temperature. In the present embodiment, the plurality of antenna substrates 30 are joined onto one wiring substrate 10 by adhesive film 6.

Adhesive film 6 may contain resin. The resin used for adhesive film 6 may have thermoplastic properties or thermosetting properties. Adhesive film 6 preferably has a small dielectric loss tangent (tan δ). The generally used adhesive film made of epoxy resin or silicone resin has a large dielectric loss tangent (tan δ). Thus, when the adhesive film made of epoxy resin or silicone resin is used as adhesive film 6, the dielectric loss of adhesive film 6 may be increased. Consequently, the loss of electromagnetic waves in antenna element 55 and array antenna apparatus 5 may be increased, so that the radiation efficiency of antenna element 55 and array antenna apparatus 5 may decrease.

Adhesive film 6 of the present embodiment has a dielectric loss tangent (tan δ) of 0.005 or less. More preferably, adhesive film 6 has a dielectric loss tangent (tan δ) of 0.003 or less. Since adhesive film 6 is located between fed patch antenna 18 and parasitic patch antenna 34, the electrical characteristics of adhesive film 6 exerts an influence upon the antenna characteristics of antenna element 55 and array antenna apparatus 5. In the present embodiment, since adhesive film 6 has a dielectric loss tangent of 0.005 or less, the loss of electromagnetic waves in antenna element 55 and array antenna apparatus 5 is suppressed, so that the radiation efficiency of antenna element 55 and array antenna apparatus 5 can be improved.

Adhesive film 6 can be made, for example, using fluorine-based thermoplastic resin or polymer alloy-based thermosetting resin. Examples of thermoplastic resin may be CuClad 6700 (registered trademark) manufactured by Arlon. Examples of thermosetting resin may be ADFLEMA NC 0201 (registered trademark) manufactured by NAMICS CORPORATION.

In the present embodiment, a thickness T (see FIG. 4) of adhesive film 6 obtained after adhesion and defined by the distance between third surface 33 of second substrate 31 and the surface of insulating layer 20 of wiring substrate 10 is about 30 μm.

Referring to FIGS. 10 to 20, an explanation will be hereinafter given with regard to the method of manufacturing array antenna apparatus 5 having a plurality of antenna elements 55 by joining a plurality of antenna substrates 30 to wiring substrate 10 according to the present embodiment.

Figure 10:
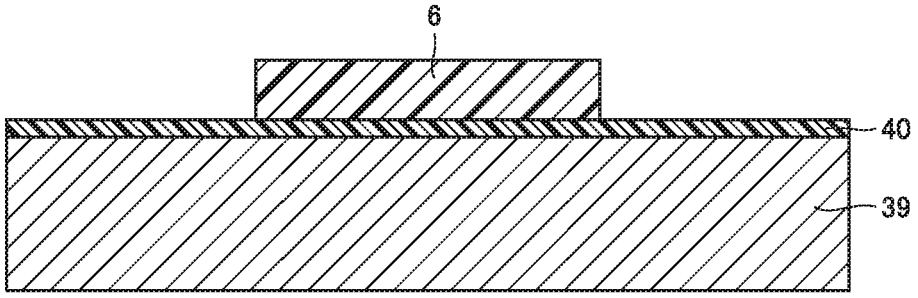
FIG. 10 is a schematic cross-sectional view of a manufacturing process of the array antenna apparatus according to the first embodiment of the present invention.

Referring to FIG. 10, adhesive film 6 is placed on a heating stage 39. A mold releasing layer 40 may be placed on the surface of heating stage 39 on which adhesive film 6 is placed. Examples of materials of mold releasing layer 40 may be fluororesin. Mold releasing layer 40 is provided on the surface of heating stage 39, so that adhesive film 6 softened in the subsequent heating step can be prevented from adhering to heating stage 39.

Figure 11:
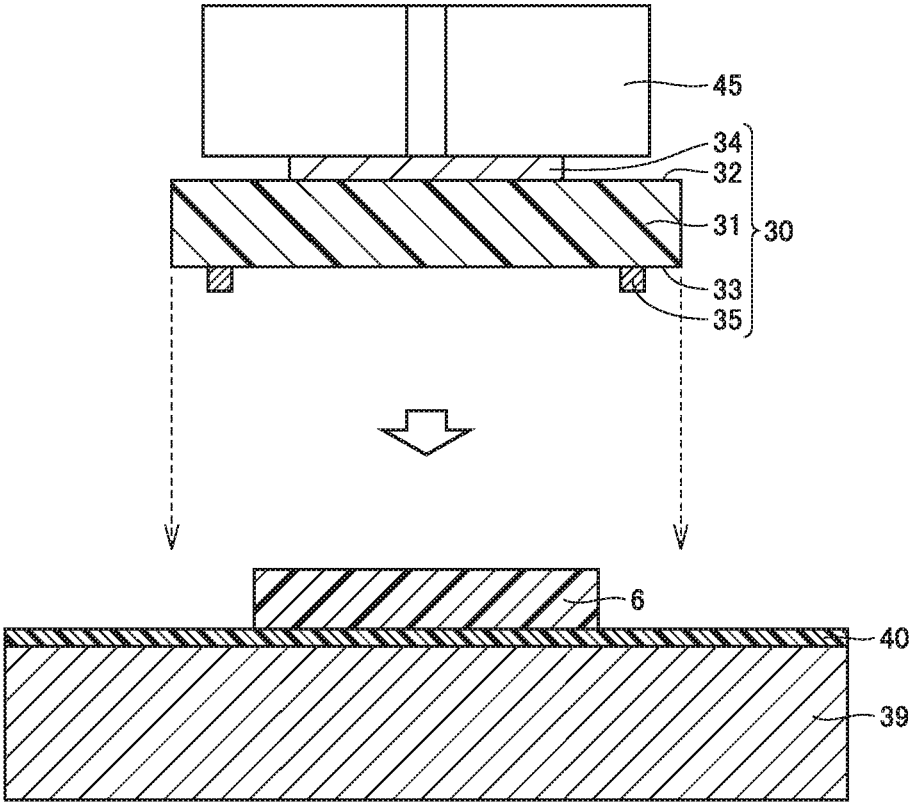
FIG. 11 is a schematic cross-sectional view of the manufacturing process of the array antenna apparatus according to the first embodiment of the present invention.

Then, referring to FIG. 11, antenna substrate 30 is aligned with adhesive film 6. In the present embodiment, antenna substrate 30 is held by a bonder head 45 provided with a heater (not shown). Then, antenna substrate 30 is aligned with adhesive film 6 using observation means such as a camera (not shown).

Figure 12:
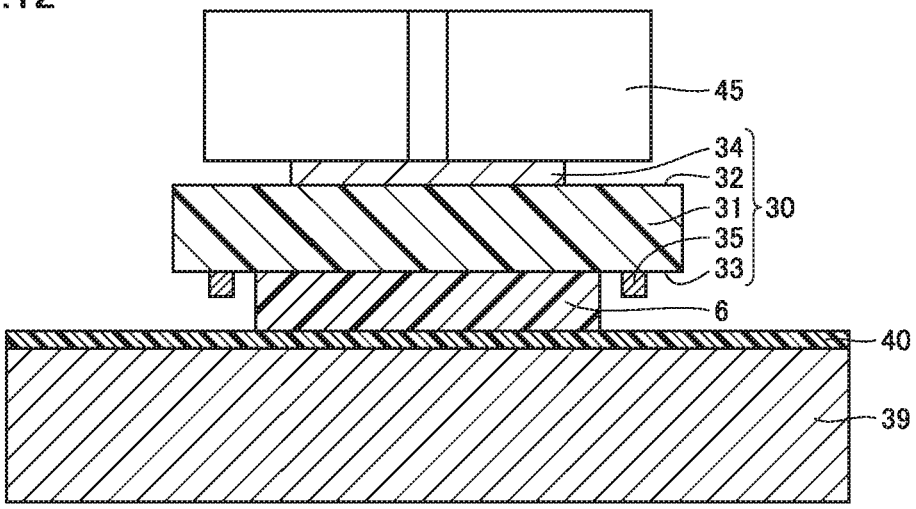
FIG. 12 is a schematic cross-sectional view of the manufacturing process of the array antenna apparatus according to the first embodiment of the present invention.
Figure 13:
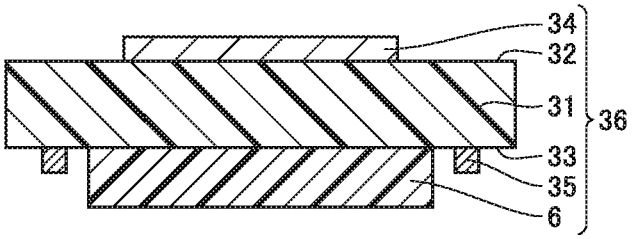
FIG. 13 is a schematic cross-sectional view of an antenna substrate with an adhesive film of the array antenna apparatus according to the first embodiment of the present invention.

Then, referring to FIG. 12, adhesive film 6 is temporarily bonded to antenna substrate 30. In the present embodiment, third surface 33 of antenna substrate 30 is pressed against adhesive film 6 by bonder head 45 while heating antenna substrate 30 by the heater of bonder head 45. Thereby, adhesive film 6 is temporarily bonded onto third surface 33 of antenna substrate 30. The external dimensions of adhesive film 6 do not substantially change before and after this temporary bonding. When adhesive film 6 is temporarily bonded onto antenna substrate 30, but if a double-sided adhesion sheet that can be bonded at a room temperature is used in place of adhesive film 6, it is not necessary to raise the temperature of bonder head 45 provided with a heater and the temperature of heating stage 39. This is because the double-sided adhesion sheet that can be bonded at a room temperature allows adhesive film 6 to be temporarily bonded onto antenna substrate 30 at a room temperature.

In the present embodiment, the above-described steps are repeatedly performed for each of the plurality of antenna substrates 30, so as to temporarily bond one adhesive film 6 onto each of the plurality of antenna substrates 30.

The plurality of antenna substrates 30 may be collectively pressed against the adhesive film sheet on which a plurality of adhesive films 6 are arranged, thereby temporarily bonding the plurality of adhesive films 6 onto the plurality of antenna substrates 30, respectively, in a collective manner.

According to the above-described steps, an antenna substrate 36 with an adhesive film can be obtained (see FIGS. 13 to 15(B)).

Figure 14:
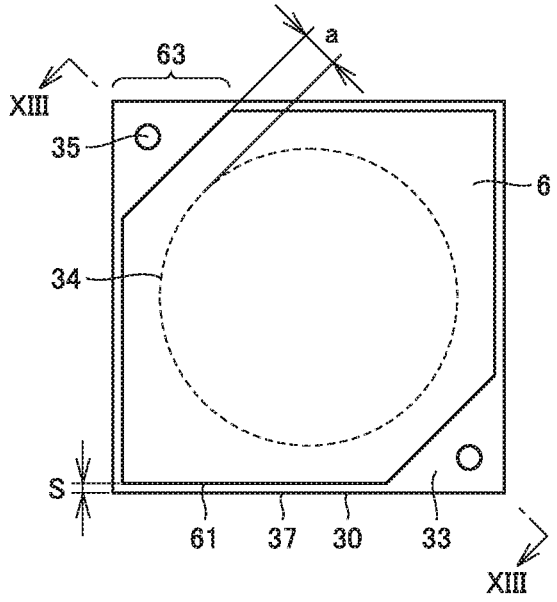
FIG. 14 is a schematic bottom view of the antenna substrate with an adhesive film of the array antenna apparatus according to the first embodiment of the present invention.

Referring to FIG. 14, in order to prevent adhesive film 6 from covering second alignment mark 35 when adhesive film 6 is temporarily bonded to third surface 33 of antenna substrate 30, a cutout portion 63 may be provided in adhesive film 6. If second alignment mark 35 is covered by adhesive film 6 when first alignment mark 25 provided on wiring substrate 10 and second alignment mark 35 provided on antenna substrate 30 are aligned with each other using observation means such as a camera, it becomes difficult to recognize second alignment mark 35 by the observation means, with the result that the alignment accuracy for antenna substrate 30 is decreased. When cutout portion 63 is provided in adhesive film 6, second alignment mark 35 can be clearly recognized using the observation means such as a camera even if adhesive film 6 is temporarily bonded onto antenna substrate 30. Accordingly, the accuracy of the alignment between wiring substrate 10 and antenna substrate 30 can be improved.

In the present embodiment, a pair of corner portions located on a diagonal line of adhesive film 6 is cut at a bevel, so that cutout portion 63 having an approximately triangular shape is provided in the pair of corner portions of adhesive film 6. Cutout portion 63 having an approximately triangular shape can be formed by cutting the corner portion of adhesive film 6.

Figure 15A:
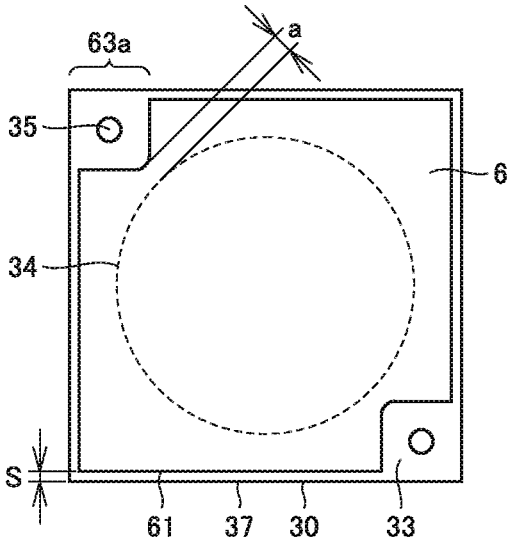
FIG. 15(A) is a schematic bottom view of an antenna substrate with an adhesive film of an array antenna apparatus according to a modification of the first embodiment of the present invention.
Figure 15B:
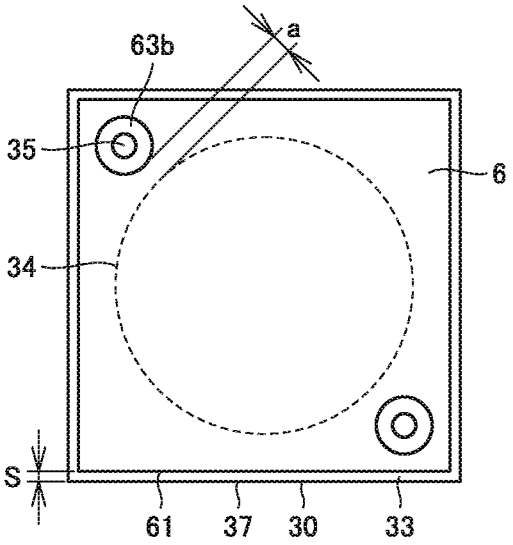
FIG. 15(B) is a schematic bottom view of an antenna substrate with an adhesive film of an array antenna apparatus according to another modification of the first embodiment of the present invention.

Cutout portion 63 only has to be provided in adhesive film 6 so as to prevent adhesive film 6 from covering second alignment mark 35, and cutout portion 63 may have other shapes. For example, as shown in FIG. 15(A), a cutout portion 63*a* having an approximately quadrangular shape may be provided at a pair of corner portions located on a diagonal line of adhesive film 6. Furthermore, as shown in FIG. 5(B a cutout portion 63*b* having an approximately circular shape may be provided in a pair of regions located on a diagonal line of adhesive film 6. Cutout portions 63*a* and 63*b* each can be formed by subjecting adhesive film 6 to cut-out processing.

Adhesive film 6 does not exist in cutout portions 63, 63*a* and 63*b*. Thus, if cutout portions 63, 63*a* and 63*b* are located in the proximity of parasitic patch antenna 34, the antenna characteristics of antenna element 55 and array antenna apparatus 5 may deviate from the designed antenna characteristics. As a result of the electromagnetic field simulation, it has been found that the antenna characteristics of array antenna apparatus 5 are not influenced even if adhesive film 6 is provided with cutout portions 63, 63*a* and 63*b*, as long as the shortest distance a between cutout portion 63 of adhesive film 6 and parasitic patch antenna 34 (see FIGS. 14 to 15(B)) is 0.2 mm or more in a plan view of antenna substrate 36 with an adhesive film as seen from the third surface 33 side. Thus, in the present embodiment, the shortest distance a between cutout portion 63 of adhesive film 6 and parasitic patch antenna 34 in a plan view of antenna substrate 36 with an adhesive film as seen from the third surface 33 side is set at 0.2 mm.

Figure 16:
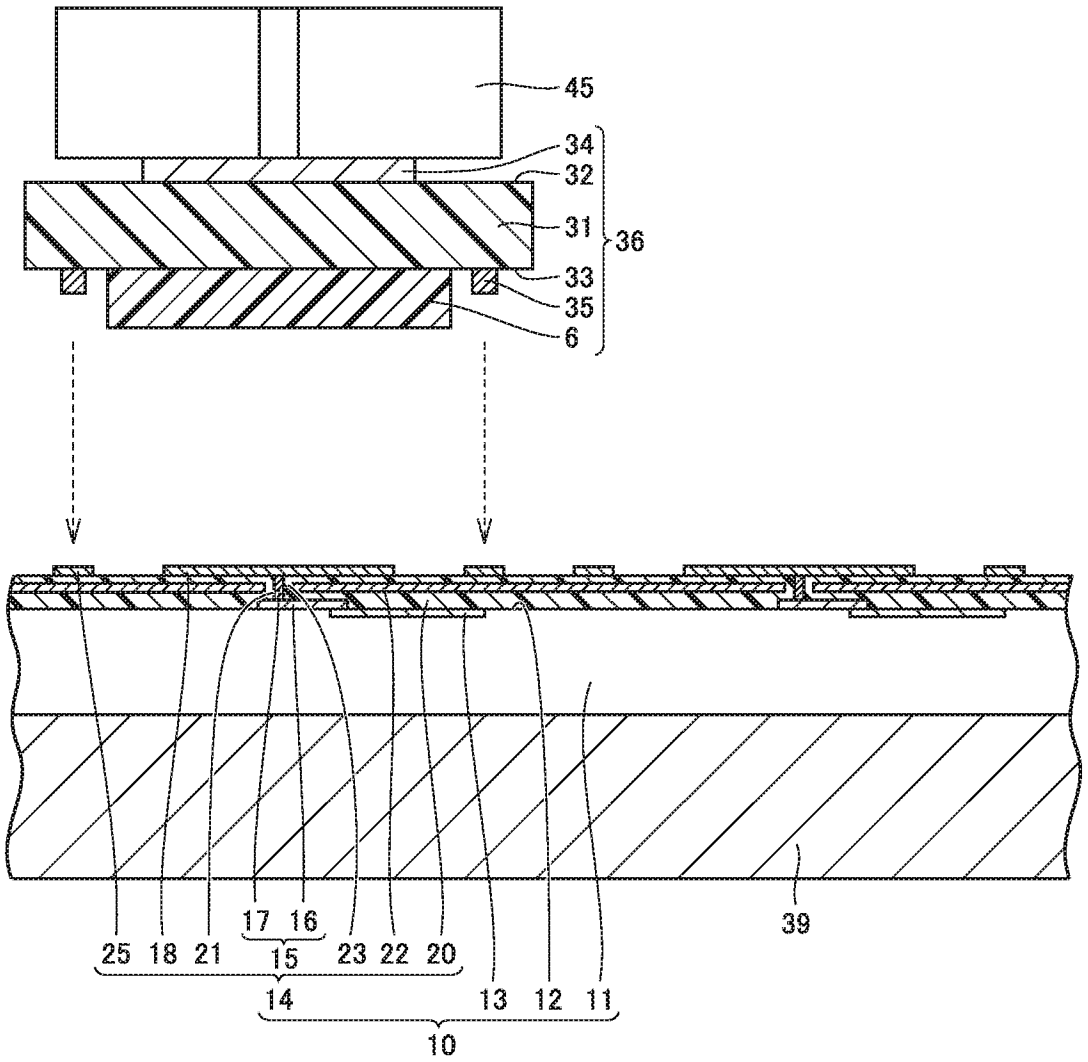
FIG. 16 is a schematic cross-sectional view of the manufacturing process of the array antenna apparatus according to the first embodiment of the present invention.

Then, referring to FIG. 16, antenna substrate 36 with an adhesive film is aligned with wiring substrate 10. In the present embodiment, antenna substrate 36 with an adhesive film is held by bonder head 45 with a heater. Then, antenna substrate 36 with an adhesive film is aligned with wiring substrate 10 while observing first alignment mark 25 provided on wiring substrate 10 and second alignment mark 35 provided on antenna substrate 36 with an adhesive film using observation means (not shown) such as a camera. For example, antenna substrate 36 with an adhesive film may be aligned with wiring substrate 10 such that the center of first alignment mark 25 provided on wiring substrate 10 and the center of second alignment mark 35 provided on antenna substrate 36 with an adhesive film are located to correspond to each other.

Figure 17:
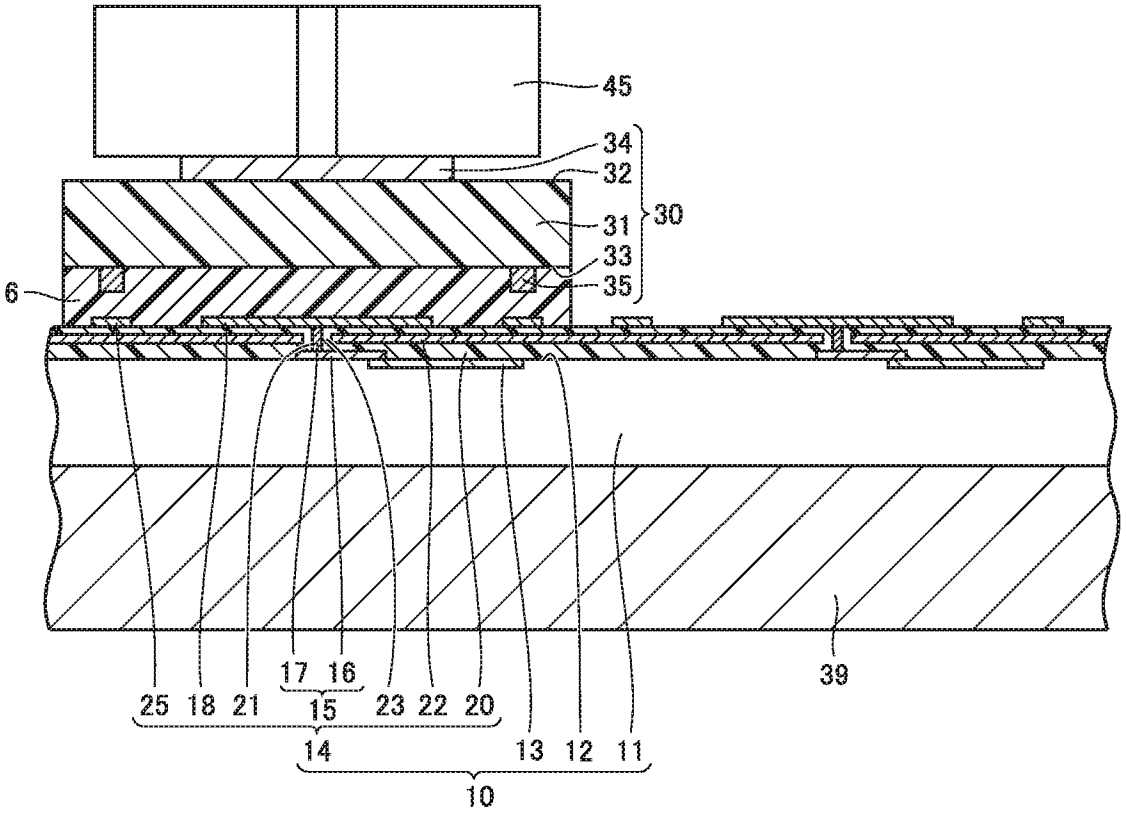
FIG. 17 is a schematic cross-sectional view of the manufacturing process of the array antenna apparatus according to the first embodiment of the present invention.

Then, referring to FIG. 17, antenna substrate 30 is substantially bonded onto wiring substrate 10. In the present embodiment, antenna substrate 36 with an adhesive film is pressed against wiring substrate 10 by bonder head 45 while heating antenna substrate 36 with an adhesive film by the heater of bonder head 45 and also heating wiring substrate 10 by heating stage 39. Thereby, antenna substrate 30 is substantially bonded onto wiring substrate 10. The step of substantially bonding antenna substrate 30 onto wiring substrate 10 is carried out at a higher temperature and with higher pressing force than those in the step of temporarily bonding adhesive film 6 onto antenna substrate 30 (see FIG. 12). Through the step of substantially bonding antenna substrate 30 onto wiring substrate 10, antenna substrate 30 is finally fixed to wiring substrate 10.

When a double-sided adhesion sheet that can be bonded at a room temperature is used as adhesive film 6, it is not necessary to raise the temperatures of the heater of bonder head 45 and heating stage 39. This is because the double-sided adhesion sheet that can be bonded at a room temperature can substantially bond antenna substrate 30 onto wiring substrate 10 at a room temperature.

Through the above-described steps, antenna substrate 30 is joined onto wiring substrate 10. In the present embodiment, antenna substrate 30 is joined onto wiring layer 14 of wiring substrate 10.

Figure 18:
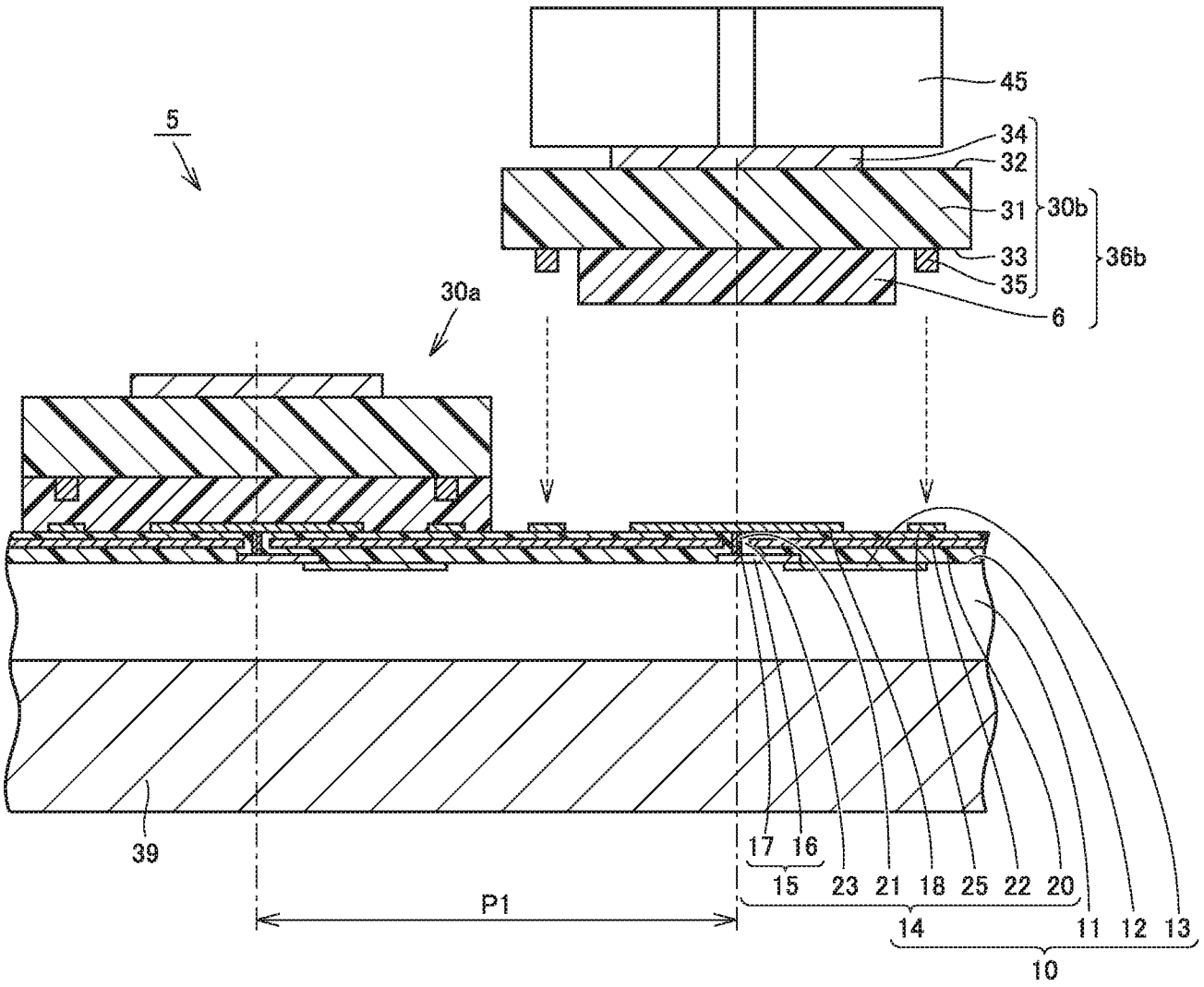
FIG. 18 is a schematic cross-sectional view of the manufacturing process of the array antenna apparatus according to the first embodiment of the present invention.
Figure 19:
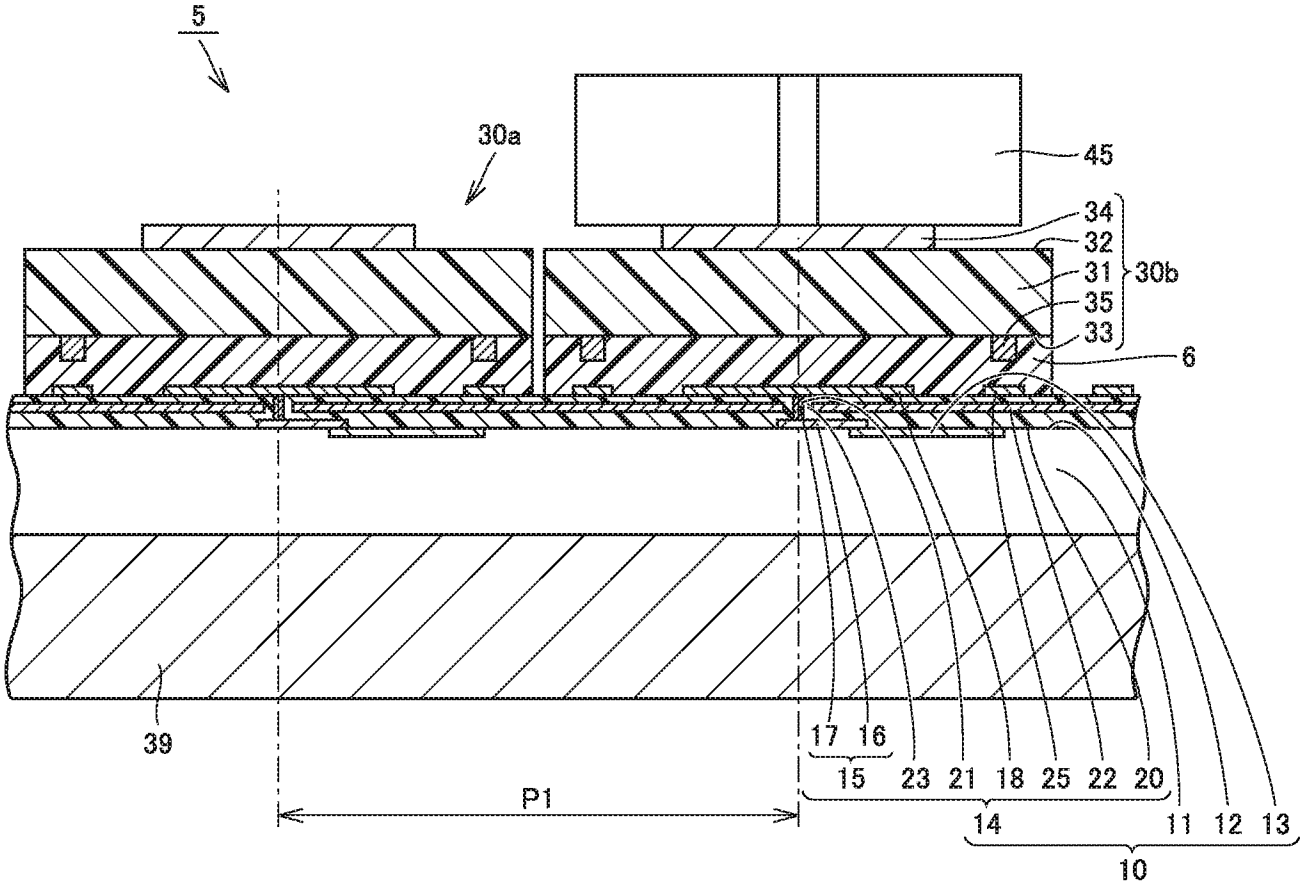
FIG. 19 is a schematic cross-sectional view of the manufacturing process of the array antenna apparatus according to the first embodiment of the present invention.
Figure 20:
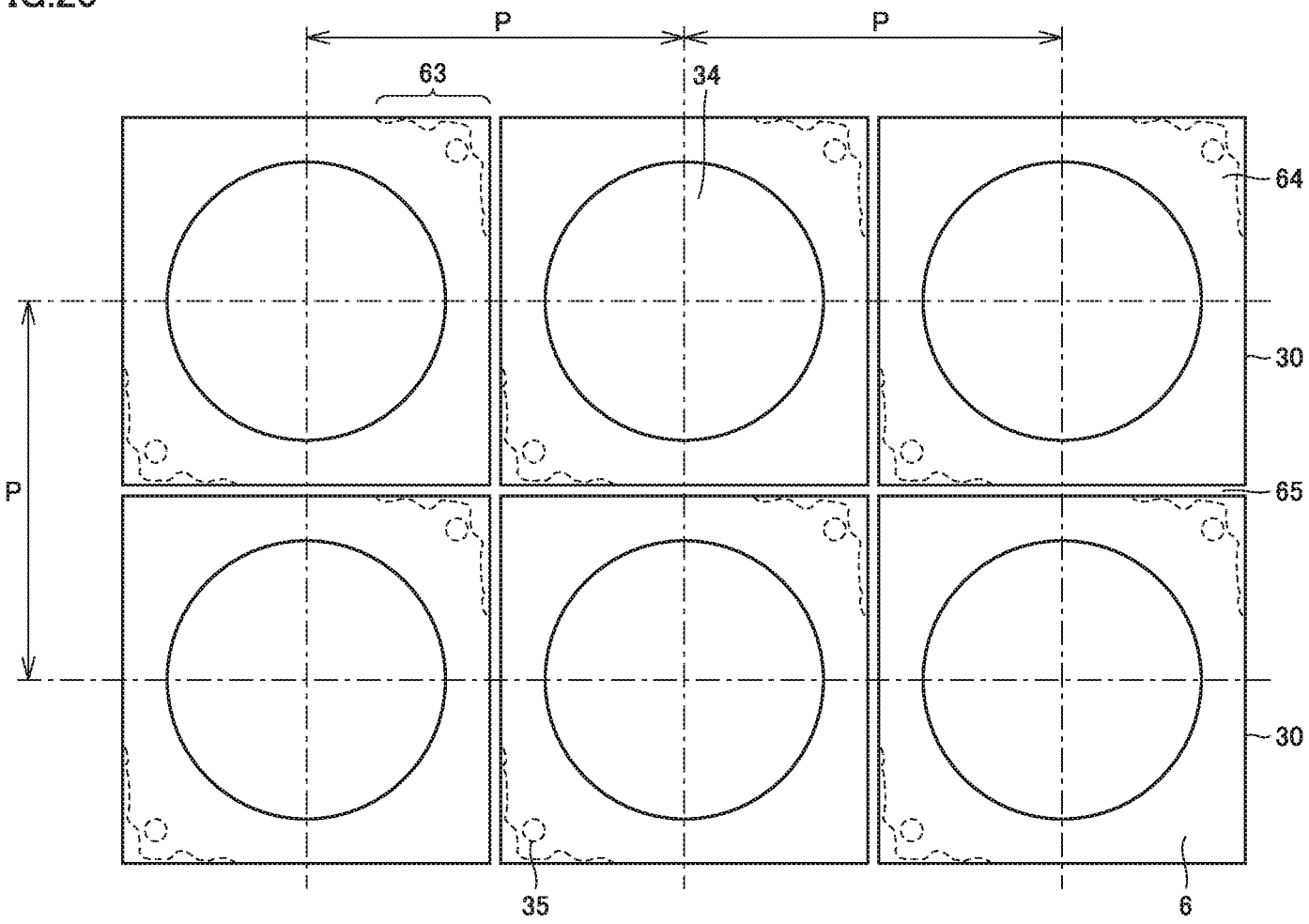
FIG. 20 is a schematic top view of the array antenna apparatus according to the first embodiment of the present invention.

Then, referring to FIGS. 18 to 20, the steps in FIGS. 16 and 17 are repeatedly carried out, so that it becomes possible to obtain array antenna apparatus 5 having a plurality of antenna substrates 30 joined onto wiring substrate 10. For example, another antenna substrate 30*b* may be joined at a position that is away at a distance of pitch P1 from the center of antenna substrate 30*a* on wiring substrate 10 onto which antenna substrate 30*a* has already been joined. In the present embodiment, a plurality of antenna substrates 30 are joined onto wiring substrate 10. The plurality of antenna substrates 30 are joined onto wiring substrate 10 in a tiled manner.

In the present embodiment, the plurality of antenna substrates 30 are joined onto wiring substrate 10 at pitch P in each of two directions that are orthogonal to each other in a plane of wiring substrate 10 (see FIGS. 5 and 20). Pitch P1 shown in FIGS. 18 and 19 is an arranging pitch for a plurality of antenna substrates 30 that are located in a direction in which a plurality of first alignment marks 25 and a plurality of second alignment marks 35 are arranged, that is, in the diagonal direction of antenna substrate 30. Accordingly, in the present embodiment, pitch P1 is square root of two times as long as pitch P.

In the present embodiment, there is a gap provided between a plurality of antenna substrates 30 adjacent to each other. The plurality of antenna substrates 30 adjacent to each other may be in contact with each other and a gap may not be provided therebetween.

Referring to FIG. 20, when antenna substrate 36 with an adhesive film is pressed against wiring substrate 10, adhesive film 6 is heated by bonder head 45 with a heater and heating stage 39 and is thereby softened. Thus, when antenna substrate 36 with an adhesive film is pressed against wiring substrate 10, adhesive film 6 is press-spread over cutout portion 63 and the like. A portion 64 of adhesive film 6 corresponds to a portion obtained by press-spreading adhesive film 6 over cutout portion 63.

When antenna substrate 36 with an adhesive film is pressed against wiring substrate 10, adhesive film 6 may extend beyond the outer periphery of antenna substrate 30. In such a case, when another antenna substrate 30*b* is to be joined adjacently to antenna substrate 30*a* that has already been joined onto wiring substrate 10 (see FIGS. 18 and 19), another antenna substrate 30*b* interferes with adhesive film 6 that extends beyond the outer periphery of antenna substrate 30*a*. Consequently, another antenna substrate 30*b* may not be able to be joined at a position that is away at a distance of pitch from the center of antenna substrate 30*a*. Furthermore, softened adhesive film 6 may overflow from between antenna substrates 30*a* and 30*b* located adjacent to each other, and then, may extend over the surface of parasitic patch antenna 34. When the softened adhesive film 6 extends over the surface of parasitic patch antenna 34, the dielectric (adhesive film 6) that is not taken into consideration during designing is to extend on parasitic patch antenna 34. Consequently, the antenna characteristics of antenna element 55 and array antenna apparatus 5 deviate from the designed antenna characteristics.

In order to prevent another antenna substrate 30*b* from interfering with adhesive film 6 extending beyond the outer periphery of antenna substrate 30*a* having already been joined onto wiring substrate 10, and also to prevent adhesive film 6 from overflowing from between antenna substrates 30*a* and 30*b* located adjacent to each other, there may be a gap of 0.1 mm or more and 1.2 mm or less, and preferably, 0.2 mm or more and 0.6 mm or less provided between antenna substrates 30 adjacent to each other. The gap between antenna substrates 30 adjacent to each other may be filled with air.

Furthermore, in order to prevent another antenna substrate 30*b* from interfering with adhesive film 6 extending beyond the outer periphery of antenna substrate 30*a* having already been joined onto wiring substrate 10, and also to prevent adhesive film 6 from overflowing from between antenna substrates 30*a* and 30*b* adjacent to each other, adhesive film 6 may be provided with a setback S in such a manner that the external dimensions of adhesive film 6 temporarily bonded to antenna substrate 30 (second substrate 31) are slightly smaller than the external dimensions of antenna substrate 30 (second substrate 31) (see FIGS. 14 and 15).

Adhesive film 6 does not exist in setback S. Accordingly, when relatively large setback S is provided, the adhesive strength between wiring substrate 10 and antenna substrate 30 is to decrease. Also, when a relatively large setback S is provided and this setback S is located in the proximity of parasitic patch antenna 34, the antenna characteristics of array antenna apparatus 5 is to deviate from the designed antenna characteristics. Accordingly, setback S is preferably 0.4 mm or less, more preferably 0.01 mm or more and 0.3 mm or less, and further more preferably 0.02 mm or more and 0.2 mm or less. Such setback S is provided in adhesive film 6. Thereby, even if adhesive film 6 is softened with pressurization and heating during substantial bonding, adhesive film 6 does not excessively extend to the outside beyond the outer periphery of antenna substrate 30 (second substrate 31), and also, adhesive film 6 does not overflow from between antenna substrates 30*a* and 30*b* adjacent to each other. Furthermore, after substantial bonding, a region with no adhesive film 6 does not exist in the proximity of parasitic patch antenna 34. Thus, array antenna apparatus 5 having excellent antenna characteristics can be obtained.

Then, array antenna apparatus having a plurality of antenna substrates 30 joined onto wiring substrate 10 is bonded onto carrier 3 using adhesive layer 4. Carrier 3 is fixed on base plate 2 with a screw or the like. Control substrates 7 and 8 are fixed on base plate 2 with a screw or the like. Pads 9 on wiring substrate 10 and pads (not shown) provided on control substrates 7 and 8 are electrically connected to each other through a wire (not shown), so that an antenna module can be obtained (FIG. 1). Wiring substrate 10 and control substrates 7 and 8 may be electrically connected to each other using: a flexible printed circuit board of polymer film base such as polyimide; an anisotropic conductive film; or the like.

The effects of array antenna apparatus 5 of the present embodiment and the method of manufacturing array antenna apparatus 5 will be hereinafter described.

In array antenna apparatus 5 of the present embodiment, a plurality of active element circuits 13 configured to perform at least one of transmission or reception of electromagnetic waves are provided on first surface 12 of first substrate 11. Thus, in the present embodiment, array antenna apparatus 5 can be reduced in size, as compared with the comparative example in which a plurality of active element circuits 13 are disposed on a plurality of different substrates, respectively, which are then mounted on a printed circuit board.

In the present embodiment, a plurality of antenna substrates 30 are joined onto one wiring substrate 10. Furthermore, in the present embodiment, the outer periphery of each of the plurality of antenna substrates 30 in a plane orthogonal to the thickness direction of each of the plurality of antenna substrates 30 is smaller than the outer periphery of wiring substrate 10 in a plane orthogonal to the thickness direction of wiring substrate 10. For example, in the present embodiment, the length of one side of antenna substrate 30 is shorter than the length of one side of wiring substrate 10.

In general, when two substrates having different coefficients of linear expansion, different dynamic physical properties, or different geometrical symmetries are joined to each other, these two substrates undergo warpage, torsion or distortion due to the heat applied when joining two substrates or the heat applied to the joined two substrates. Such warpage, torsion or distortion is greater as the area in which these two substrates face each other are larger. In the present embodiment, one wiring substrate 10 is provided whereas antenna substrate 30 is divided into a plurality of pieces. Thus, the area in which one wiring substrate 10 and one antenna substrate 30 face each other is smaller in the present embodiment than in the comparative example in which the antenna substrate is provided as one substrate having the same area as that of the wiring substrate. Consequently, in the present embodiment, warpage, torsion or distortion occurring in wiring substrate 10 and the plurality of antenna substrates 30 can be reduced.

In other words, in the comparative example in which the antenna substrate has the same large area as that of the wiring substrate, the heat applied when joining the wiring substrate and the antenna substrate or the heat emitted from the array antenna apparatus during use of the array antenna apparatus causes warpage, torsion or distortion in one region of the antenna substrate, and such warpage, torsion or distortion exerts cumulative influences upon another region adjacent to this one region of the antenna substrate. Accordingly, the warpage, torsion or distortion in the wiring substrate and the antenna substrate is increased. On the other hand, in the present embodiment, antenna substrate 30 is divided into a plurality of pieces. Therefore, the heat applied when joining wiring substrate 10 and a plurality of antenna substrates 30 or the heat emitted from array antenna apparatus 5 during use of this array antenna apparatus 5 causes one antenna substrate 30 to undergo warpage, torsion or distortion, which however does not exert cumulative influences upon warpage, torsion or distortion occurring in another antenna substrate 30 adjacent to this one antenna substrate 30. Consequently, in the present embodiment, warpage, torsion or distortion occurring in wiring substrate 10 and the plurality of antenna substrates 30 can be reduced.

As in the present embodiment, when warpage, torsion or distortion in wiring substrate 10 and the plurality of antenna substrates 30 is reduced, for example, (1) the position of parasitic patch antenna 34 relative to fed patch antenna 18 and the plurality of active element circuits 13 and (2) the inclination of parasitic patch antenna 34 relative to fed patch antenna 18 are less deviated from the design values. Thus, in array antenna apparatus 5 having a plurality of antenna elements 55 in the present embodiment, the positional misalignment among the plurality of antenna elements 55 can be reduced while the inclination displacement of the plurality of antenna elements 55 can also be reduced, so that array antenna apparatus 5 having excellent antenna characteristics can be obtained.

Also, in the present embodiment, any materials suitable to the antenna characteristics of the plurality of antenna elements 55 and array antenna apparatus 5 can be selected as the material of wiring substrate 10 (first substrate 11) and the material of antenna substrate 30 (second substrate 31) without considering warpage, torsion or distortion in antenna substrate 30. Consequently, array antenna apparatus 5 having excellent antenna characteristics can be obtained.

For example, when a fluororesin-based high-frequency printed circuit board with low dielectric loss that is suitable for transmission or reception of high-frequency electromagnetic waves such as a microwave or a millimeter wave is used as second substrate 31, the coefficient of linear expansion in the in-plane direction of second substrate 31 is given by the coefficient of linear expansion of copper of 16.5 ppm/° C., of which the conductor contained in the printed circuit board is made. On the other hand, when a silicon wafer is used as first substrate 11, the coefficient of linear expansion in the in-plane direction of first substrate 11 is given by the coefficient of linear expansion of silicon of 3.5 ppm/° C. If each of the wiring substrate and the antenna substrate is formed of one substrate, the heat applied when joining the wiring substrate and the antenna substrate or the heat emitted from the array antenna apparatus during use of this array antenna apparatus causes large warpage, large torsion or large distortion to occur in the wiring substrate and the antenna substrate. Accordingly, the position of the antenna element deviates greatly from the designed position, so that the antenna characteristics of the array antenna apparatus may deteriorate.

Furthermore, in a fluororesin-based high-frequency printed circuit board with low dielectric loss, the amount of glass fibers and other additives contained in the high-frequency printed circuit board is set to be small in order to keep, to the extent possible, the low dielectric loss characteristics of the base material itself of the high-frequency printed circuit board. Accordingly, by the heat applied when joining the wiring substrate and the antenna substrate or the heat emitted from the array antenna apparatus during use of this array antenna apparatus, larger warpage, larger torsion or larger distortion occurs in the antenna substrate formed of a fluororesin-based high-frequency printed circuit board with low dielectric loss. Consequently, the position of the antenna element deviates more greatly from the designed position, so that the antenna characteristics of the array antenna apparatus may further deteriorate.

On the other hand, in the present embodiment, one wiring substrate 10 is provided whereas antenna substrate 30 is divided into a plurality of pieces. Accordingly, even if one antenna substrate 30 undergoes warpage, torsion or distortion caused by the heat applied when joining wiring substrate 10 and a plurality of antenna substrates 30 or the heat emitted from array antenna apparatus 5 during use of array antenna apparatus 5, such warpage, torsion or distortion occurring in this one antenna substrate 30 does not exert cumulative influences upon the warpage, torsion or distortion occurring in another antenna substrate 30 adjacent to this one antenna substrate 30. Thus, the warpage, torsion or distortion occurring in antenna elements 55 and array antenna apparatus 5 can be reduced. Consequently, array antenna apparatus 5 having excellent antenna characteristics can be obtained.

Also, in the present embodiment, any materials suitable to the antenna characteristics of the plurality of antenna elements 55 and array antenna apparatus 5 can be selected as the material of wiring substrate 10 (first substrate 11) and the material of antenna substrate 30 (second substrate 31) without considering warpage, torsion or distortion in antenna substrate 30. For example, the materials that can be selected for wiring substrate 10 (first substrate 11) and antenna substrate 30 (second substrate 31) are such materials by which the difference between the coefficient of linear expansion of wiring substrate 10 (first substrate 11) and the coefficient of linear expansion of antenna substrate 30 (second substrate 31) is 10 ppm/° C. or higher. Consequently, array antenna apparatus 5 having excellent antenna characteristics can be obtained.

In the present embodiment, a plurality of active element circuits 13 configured to perform at least one of transmission or reception of electromagnetic waves and a plurality of fed patch antennas 18 are provided on first substrate 11. Thus, as compared with the comparative example in which a substrate having a plurality of active element circuits 13 formed thereon and another substrate having a plurality of fed patch antennas 18 formed thereon are joined to each other, it becomes possible to suppress occurrence of positional misalignment between the plurality of active element circuits 13 and the plurality of fed patch antennas 18. Consequently, array antenna apparatus 5 of the present embodiment can suppress the transmission loss of high-frequency electromagnetic waves such as a microwave and a millimeter wave, and also suppress generation of electromagnetic wave noise.

In the present embodiment, since wiring layer 14 having electrical connection 15 is provided, electrical connection 15 can be routed from active element circuit 13 to arbitrary positions. Accordingly, the position of active element circuit 13 relative to fed patch antenna 18 can be freely designed.

In the present embodiment, at least a part of electrical connection 15 electrically connecting each of fed patch antennas 18 and each of the plurality of active element circuits 13 for performing at least one of transmission or reception of electromagnetic waves is provided inside insulating layer 20. Accordingly, not only a semi-insulating substrate but also a normal semiconductor substrate with no semi-insulating properties can be used as first substrate 11 on which a plurality of active element circuits 13 for performing at least one of transmission or reception of electromagnetic waves are disposed.

In the present embodiment, ground conductor layer 22 is provided between the plurality of active element circuits 13 and the plurality of fed patch antennas 18. Thus, the electromagnetic noise generated in the plurality of active element circuits 13 and the like is shielded by ground conductor layer 22, and thus, not coupled to the plurality of fed patch antennas 18. Therefore, a plurality of antenna elements 55 and array antenna apparatus 5 exhibiting excellent antenna performance can be provided.

In the case where resin is employed as insulating layer 20, insulating layer 20 made of resin is softened by the heat applied when joining wiring substrate 10 and the plurality of antenna substrates 30 or the heat emitted from array antenna apparatus 5 during use of this array antenna apparatus 5. Thus, when joining wiring substrate 10 and the plurality of antenna substrates 30 or during use of array antenna apparatus 5, insulating layer 20 made of resin is deformed, so that warpage, torsion or distortion occurring in antenna substrate 30 can be further reduced.

In the present embodiment, resin can be employed as adhesive film 6. Adhesive film 6 made of resin is softened by the heat applied when joining wiring substrate 10 and the plurality of antenna substrates 30 or the heat emitted from array antenna apparatus 5 during use of this array antenna apparatus 5. Accordingly, when joining wiling substrate 10 and the plurality of antenna substrates 30 or during use of array antenna apparatus 5, adhesive film 6 made of resin is deformed, so that warpage, torsion or distortion occurring in antenna substrate 30 can be further reduced.

In the present embodiment, adhesive film 6 may have a dielectric loss tangent of 0.005 or less. Since adhesive film 6 is located between fed patch antenna 18 and parasitic patch antenna 34, the electrical characteristics of adhesive film 6 exerts influences upon the antenna characteristics of antenna elements 55 and array antenna apparatus 5. In the present embodiment, since adhesive film 6 has a dielectric loss tangent of 0.005 or less, the loss of electromagnetic waves in the plurality of antenna elements 55 and array antenna apparatus 5 is reduced, so that the radiation efficiency or the reception efficiency of the plurality of antenna elements 55 and array antenna apparatus 5 can be improved.

Each of antenna elements 55 of array antenna apparatus 5 in the present embodiment has parasitic patch antenna 34 in addition to fed patch antenna 18. When parasitic patch antenna 34 is provided in array antenna apparatus 5 of the present embodiment, the frequency band of electromagnetic waves available to array antenna apparatus 5 can be widened, so that the electromagnetic loss in array antenna apparatus 5 can be decreased.

In the present embodiment, parasitic patch antenna 34 is provided on second surface 32 of antenna substrate 30, and third surface 33 of antenna substrate 30 on the opposite side of second surface 32 is joined onto wiring substrate 10. Antenna substrate 30 has a thickness of 100 μm or more and 1 mm or less. In the present embodiment, fed patch antenna 18 and parasitic patch antenna 34 are separated at least by the thickness of antenna substrate 30 (second substrate 31). Accordingly, in the present embodiment, the distance between fed patch antenna 18 and parasitic patch antenna 34 can be increased. Second substrate 31 can be formed, for example, so as to have a thickness of 100 μm or more readily by employing a printed circuit board or the like as second substrate 31.

The antenna characteristics of antenna element 55 and array antenna apparatus 5 can be adjusted by the electrical characteristics of the materials forming antenna element 55 and array antenna apparatus 5. In the present embodiment, the distance between fed patch antenna 18 and parasitic patch antenna 34 can be increased. Consequently, the design flexibility for antenna element 55 and array antenna apparatus 5 is increased, so that it becomes possible to obtain antenna element 55 and array antenna apparatus 5 exhibiting high radiation efficiency and a wide frequency bandwidth of available electromagnetic waves.

On the other hand, for example, in the antenna element and the array antenna apparatus in which fed patch antenna 18 and parasitic patch antenna 34 are separated only by a dielectric resin layer, it is difficult to form a dielectric resin layer so as to have a thickness of 100 μm. Thus, it is difficult to increase the distance between fed patch antenna 18 and parasitic patch antenna 34. Consequently, the design flexibility for antenna element 55 and array antenna apparatus 5 is decreased, so that it becomes difficult to achieve an antenna element and an array antenna apparatus with high performance.

In the present embodiment, the thickness of second substrate 31 is set to be 1 mm or less. Thereby, a double-sided printed circuit board having second surface 32 and third surface 33 each having copper foil formed thereon is subjected to cut-out processing, so that second substrate 31 can be obtained. Accordingly, the outer shapes of second substrate 31 and antenna substrate 30 can be precisely adjusted, so that the antenna characteristics of the plurality of antenna elements 55 can be rendered uniform. Also, a plurality of antenna substrates 30 can be manufactured with efficiency at low cost.

In the present embodiment, second substrate 31 may have a dielectric loss tangent of 0.003 or less. Since the dielectric loss in second substrate 31 is relatively small, the loss of electromagnetic waves in each of antenna element 55 and array antenna apparatus 5 is reduced. Thus, the radiation efficiency and the reception efficiency of each of antenna element 55 and array antenna apparatus 5 can be improved. Furthermore, in the present embodiment, each of the plurality of antenna substrates 30 is aligned with wiring substrate 10 using first alignment mark 25 provided on wiring substrate 10 and second alignment mark 35 provided on each of the plurality of antenna substrates 30. Accordingly, the plurality of antenna substrates 30 can be joined onto wiring substrate 10 with accuracy, so that antenna element 55 and array antenna apparatus 5 with high performance can be provided.

In the present embodiment, adhesive film 6 is temporarily bonded onto a plurality of antenna substrates 30 in such a manner that adhesive film 6 does not cover second alignment marks 35 on the plurality of antenna substrates 30. Since each second alignment mark 35 is not covered by adhesive film 6, each second alignment mark 35 can be clearly recognized using observation means such as a camera. The accuracy of alignment between wiring substrate 10 and the plurality of antenna substrates 30 can be improved by second alignment mark 35 not covered by adhesive film 6.

As a modification of the present embodiment, alignment between wiring substrate 10 and the plurality of antenna substrates 30 may be performed by the steps of: determining the center position of each of the plurality of fed patch antennas 18 and the center position of parasitic patch antenna 34 on each of the plurality of antenna substrates 30; and aligning each of the plurality of antenna substrates 30 with wiring substrate 10 such that the center position of each of fed patch antennas 18 and the center position of each of parasitic patch antennas 34 are located to correspond to each other. In this modification, since the step of forming first alignment mark 25 and second alignment mark 35 can be eliminated, the manufacturing process can be simplified. Also in this modification, even if parasitic patch antenna 34 is formed over the entire second surface 32 of antenna substrate 30 (second substrate 31), wiring substrate 10 (first substrate 11) and the plurality of antenna substrates 30 (second substrate 31) can be accurately aligned. Accordingly, the design flexibility for parasitic patch antenna 34 is improved.

Second Embodiment

Referring to FIGS. 21 to 25, an explanation will be hereinafter given with regard to the method of manufacturing an array antenna apparatus 5*a* according to the second embodiment by joining a plurality of antenna substrates 30 onto wiring substrate 10. In the second embodiment, a modification of the method of manufacturing array antenna apparatus 5 of the first embodiment will be described. Array antenna apparatus 5*a* of the second embodiment basically has the same configuration and can achieve the same effect as those of array antenna apparatus 5 in the first embodiment shown in FIG. 4, but is different mainly in the following points.

In the first embodiment, a plurality of antenna substrates 30 are substantially bonded one by one onto wiring substrate 10, to thereby manufacture array antenna apparatus 5 in which a plurality of antenna substrates 30 are joined onto wiring substrate 10. On the other hand, in the present embodiment, the plurality of antenna substrates 30 are first temporarily bonded onto wiring substrate 10. Then, a heat pressing apparatus 43 with a heater is used to collectively press the plurality of antenna substrates 30 against wiring substrate 10, thereby substantially bonding the plurality of antenna substrates 30 onto wiring substrate 10 in a collective manner. Through the above-described steps, array antenna apparatus 5*a* of the present embodiment is manufactured.

The step of manufacturing antenna substrate 36 with an adhesive film (see FIGS. 10 to 14) and the step of aligning antenna substrate 36 with an adhesive film with wiring substrate 10 (see FIG. 16) are the same between the present embodiment and the first embodiment.

Figure 21:
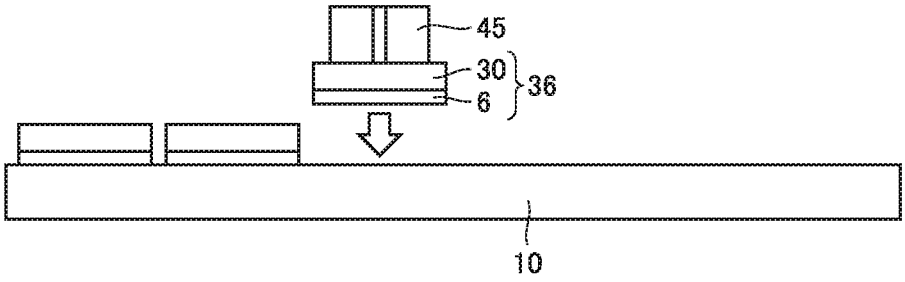
FIG. 21 is a schematic side view of a manufacturing process of an array antenna apparatus according to the second embodiment of the present invention.
Figure 22:
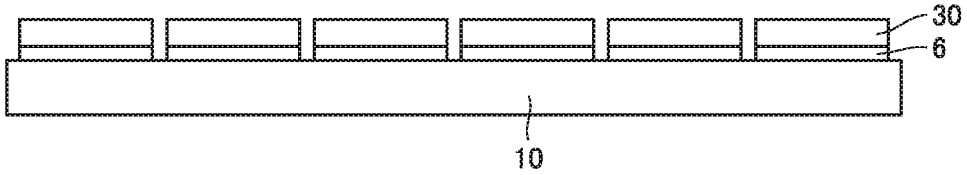
FIG. 22 is a schematic side view of the manufacturing process of the array antenna apparatus according to the second embodiment of the present invention.

Then, referring to FIGS. 21 and 22, more than one antenna substrate 36 with an adhesive film is temporarily bonded onto wiring substrate 10. In the present embodiment, antenna substrate 36 with an adhesive film is pressed against wiring substrate 10 by bonder head 45 while heating antenna substrate 36 with an adhesive film by a heater (not shown) of bonder head 45. Thereby, antenna substrate 36 with an adhesive film is temporarily bonded onto wiring substrate 10. In the present embodiment, the above-described steps are repeatedly carried out for each antenna substrate 36 with an adhesive film, thereby temporarily bonding a plurality of antenna substrates 30 one by one onto wiring substrate 10. The plurality of antenna substrates 36 with adhesive films may be temporarily bonded onto wiring substrate 10 in a collective manner.

The step of temporarily bonding more than one antenna substrate 36 with an adhesive film onto wiring substrate 10 in the present embodiment is performed at the same temperature with the same pressing force as those in the step of temporarily bonding adhesive film 6 onto antenna substrate 30 (see FIG. 17). The number of antenna substrate 36 with an adhesive film that is temporarily bonded onto wiring substrate 10 may be more than one. In the present embodiment, all of the plurality of antenna substrates 36 with adhesive films mounted on wiring substrate 10 are temporarily bonded onto wiring substrate 10.

Figure 23:
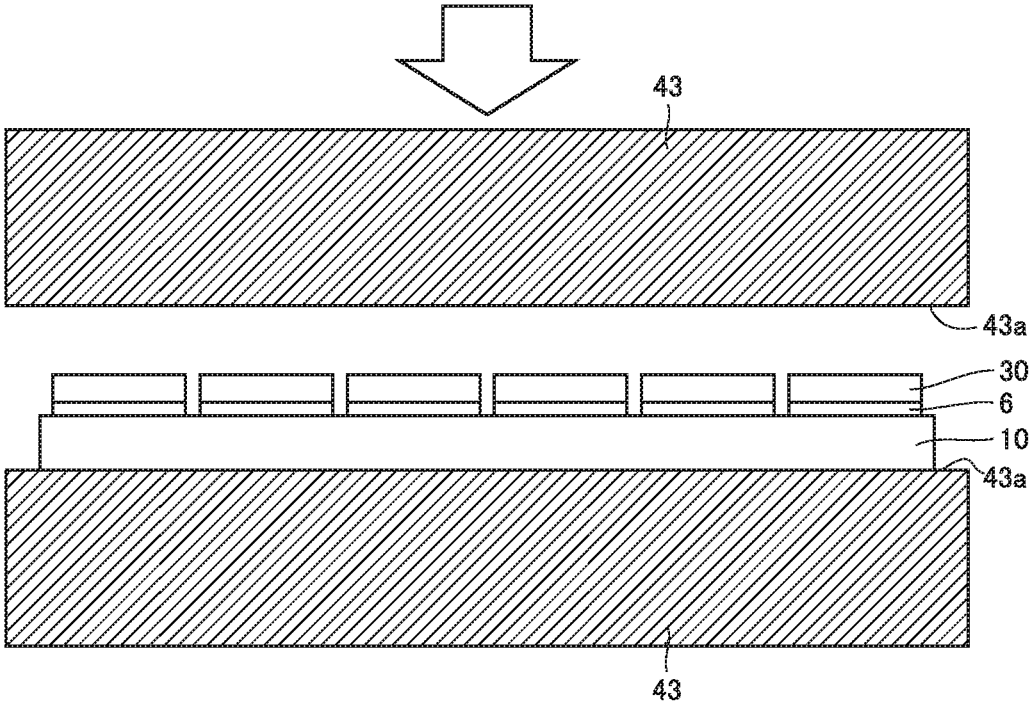
FIG. 23 is a schematic side view of the manufacturing process of the array antenna apparatus according to the second embodiment of the present invention.
Figure 24:
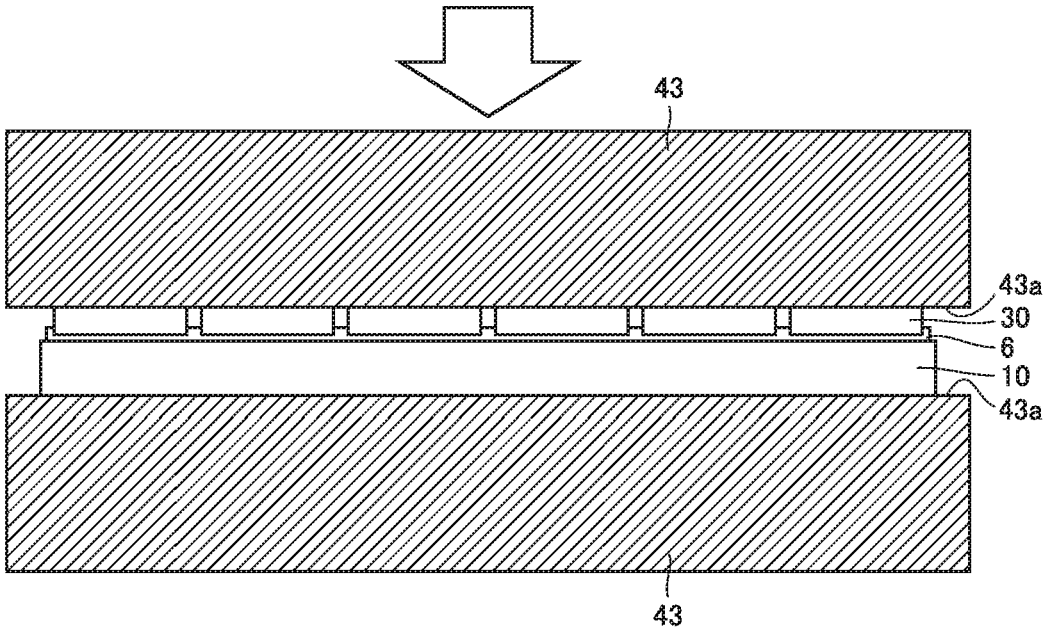
FIG. 24 is a schematic side view of the manufacturing process of the array antenna apparatus according to the second embodiment of the present invention.
Figure 25:
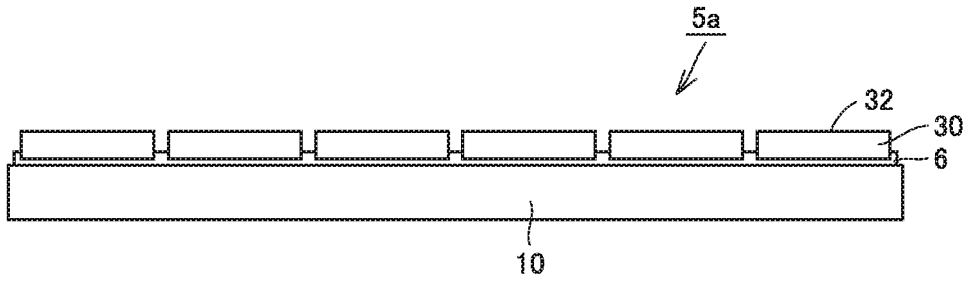
FIG. 25 is a schematic side view of the array antenna apparatus according to the second embodiment of the present invention.

Then, referring to FIGS. 23 to 25, heat pressing apparatus 43 with a heater (not shown) used to substantially bond a plurality of antenna substrates 30 onto wiring substrate 10 in a collective manner. In the present embodiment, a plurality of antenna substrates 36 with adhesive films are pressed with bonder head 45 against wiring substrate 10 in a collective manner while heating the plurality of antenna substrates 36 with adhesive films and wiring substrate 10 by the heater of heat pressing apparatus 43. Thereby, the plurality of antenna substrates 30 are substantially bonded onto wiring substrate 10 in a collective manner. The step of substantially bonding a plurality of antenna substrates 30 onto wiring substrate 10 in a collective manner is performed at a higher temperature and with higher pressing force than those in the step of temporarily bonding the plurality of antenna substrates 36 with adhesive films onto wiring substrate 10 (see FIGS. 21 and 22). Through the step of substantially bonding the plurality of antenna substrates 30 collectively onto wiring substrate 10, the plurality of antenna substrates 30 are finally fixed on wiring substrate 10. In this way, array antenna apparatus 5*a* having a plurality of antenna substrates 30 joined onto wiring substrate 10 can be obtained.

The number of antenna substrates 30 substantially bonded onto wiring substrate 10 in a collective manner by one pressure from heat pressing apparatus 43 with a heater may be more than one. In the present embodiment, all of the plurality of antenna substrates 30 are substantially bonded onto wiring substrate 10 in a collective manner by one pressure from heat pressing apparatus 43 with a heater. Accordingly, in the present embodiment, a pressing surface 43*a* of heat pressing apparatus 43 with a heater is larger in size than wiring substrate 10 and the plurality of antenna substrates 30.

In the first embodiment, a plurality of antenna substrates 30 are substantially bonded one by one onto wiring substrate 10. Thus, for the reasons of: changes in pressing force against each of the plurality of antenna substrates 30; changes in temperature when pressing each of the plurality of antenna substrates 30; and the like, the degree of softening of adhesive film 6 and the degree of deformation of adhesive film 6 may vary among the plurality of antenna substrates 30. Accordingly, for example, after substantially bonding the plurality of antenna substrates 30 onto wiring substrate 10, the distance between fed patch antenna 18 and parasitic patch antenna 34, the inclination of parasitic patch antenna 34 relative to fed patch antenna 18, or the like may vary among the plurality of antenna substrates 30. Consequently, the antenna characteristics of the plurality of antenna elements 55 may vary.

On the other hand, in the present embodiment, the plurality of antenna substrates 30 temporarily bonded onto wiring substrate 10 are collectively pressed. Accordingly, when the plurality of antenna substrates 30 are substantially bonded onto wiring substrate 10, the equal pressing force and the equal temperature can be applied to the plurality of antenna substrates 30. Also, pressing surface 43*a* of heat pressing apparatus 43 with a heater generally has excellent surface accuracy. Accordingly, after the plurality of antenna substrates 30 are substantially bonded onto wiring substrate 10, the distance between fed patch antenna 18 and parasitic patch antenna 34, the inclination of parasitic patch antenna 34 relative to fed patch antenna 18 or the like becomes uniform among the plurality of antenna substrates 30. Consequently, the antenna characteristics of the plurality of antenna elements 55 can be rendered uniform.

Third Embodiment

Figure 26:
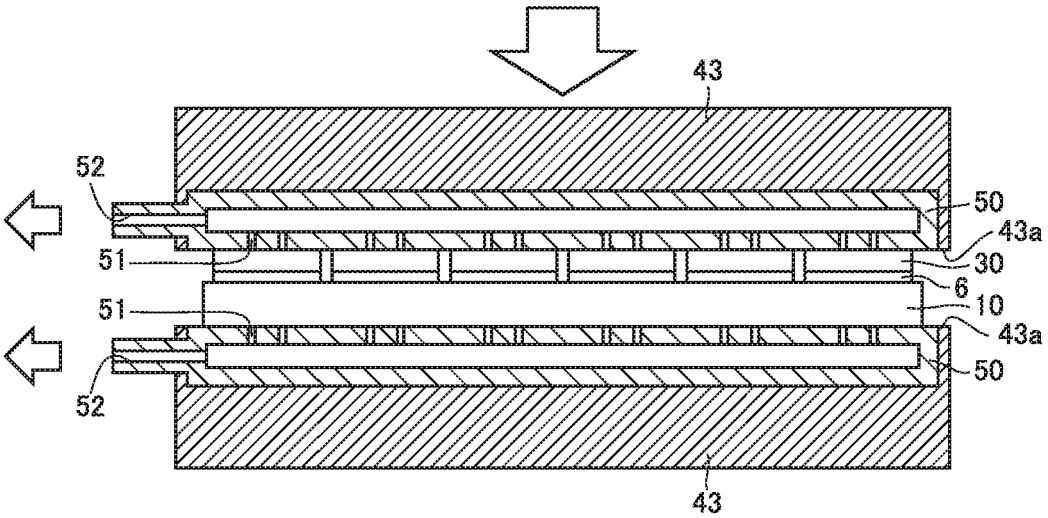
FIG. 26 is a schematic side view of a manufacturing process of an array antenna apparatus according to the third embodiment of the present invention.
Figure 27:
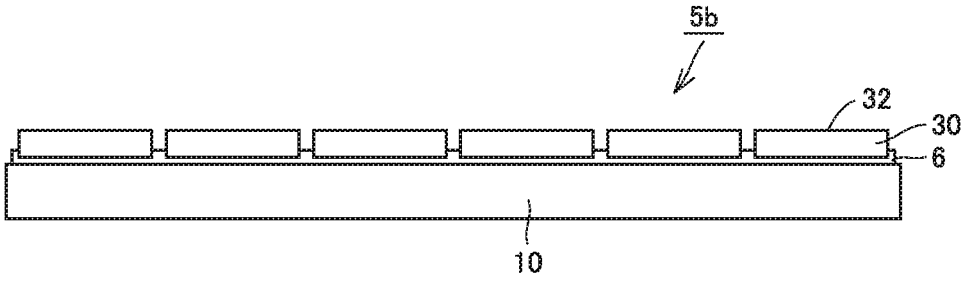
FIG. 27 is a schematic side view of the array antenna apparatus according to the third embodiment of the present invention.

Referring to FIGS. 26 and 27, an explanation will be hereinafter given with regard to the method of manufacturing an array antenna apparatus 5*b* according to the third embodiment by joining a plurality of antenna substrates 30 onto wiring substrate 10. In the third embodiment, a modification of the method of manufacturing array antenna apparatus 5*a* of the second embodiment will be described. Array antenna apparatus 5*b* of the third embodiment basically has the same configuration and can achieve the same effect as those in array antenna apparatus 5*a* of the second embodiment shown in FIG. 25, but is different mainly in the following points.

In the second embodiment, heat pressing apparatus 43 with a heater is used to substantially bond the plurality of antenna substrates 30 onto wiring substrate 10 in a collective manner, thereby manufacturing array antenna apparatus 5*a*. On the other hand, in the present embodiment, first, a heat pressing apparatus 43 including a vacuum adsorption mechanism 50 and a heater (not shown) is used to cause the plurality of antenna substrates 30 and wiring substrate 10 to adsorb onto heat pressing apparatus 43. Then, in the state where the plurality of antenna substrates 30 and wiring substrate 10 are adsorbed onto heat pressing apparatus 43, the plurality of antenna substrates 30 and wiring substrate 10 are heated with heat pressing apparatus 43. In this way, the plurality of antenna substrates 30 are collectively pressed against wiring substrate 10 using heat pressing apparatus 43. Thus, the plurality of antenna substrates 30 are substantially bonded onto wiring substrate 10 in a collective manner to thereby manufacture array antenna apparatus 5*b* of the present embodiment.

The steps up to the step of temporarily bonding the plurality of antenna substrates 36 with adhesive films onto wiring substrate 10 (see FIGS. 21 and 22) are the same between the present embodiment and the second embodiment.

In the second embodiment, the plurality of antenna substrates 30 are heated and pressed collectively against wiring substrate 10 by heat pressing apparatus 43 with a heater, to thereby substantially bond the plurality of antenna substrates 30 onto wiring substrate 10 in a collective manner. Adhesive film 6 is softened when the temperature of the heater of heat pressing apparatus 43 rises during substantial bonding. Accordingly, in the case where antenna substrate 30 is inclined relative to the surface of wiring substrate 10 during temporary bonding, the case where unexpected external force is applied to antenna substrate 30 while raising the temperature of the heater of heat pressing apparatus 43 for substantial bonding, or the like, antenna substrate 30 may deviate from the position for antenna substrate 30 aligned in the temporarily bonding step. Consequently, the distance between fed patch antenna 18 and parasitic patch antenna 34, the inclination of parasitic patch antenna 34 relative to fed patch antenna 18, or the like may deviate from the design values, so that the antenna characteristics of the plurality of antenna elements 55 and array antenna apparatus 5*a* may deteriorate.

On the other hand, in the present embodiment, the plurality of antenna substrates 30 and wiring substrate 10 are adsorbed onto heat pressing apparatus 43 during a time period from before heating of the plurality of antenna substrates 30 temporarily bonded onto wiring substrate 10 until completion of substantial bonding of the plurality of antenna substrates 30 onto wiring substrate 10 in a collective manner.

In order to cause the plurality of antenna substrates 30 and wiring substrate 10 to adsorb onto heat pressing apparatus 43, heat pressing apparatus 43 of the present embodiment includes, in addition to a heater, a vacuum adsorption mechanism 50 on its pressing surface 43*a*. Examples of vacuum adsorption mechanism 50 may be a vacuum adsorption stage. Vacuum adsorption mechanism 50 has a plurality of openings 51 and an exhaust port 52. The plurality of openings 51 are provided in a portion of pressing surface 43*a* that faces each of the plurality of antenna substrates 30 and also in a portion of pressing surface 43*a* that faces wiring substrate 10.

By exhausting air through exhaust port 52 of vacuum adsorption mechanism 50, the plurality of antenna substrates 30 and wiring substrate 10 are adsorbed onto pressing surfaces 43*a* of heat pressing apparatus 43. Then, the plurality of antenna substrates 30 and wiring substrate 10 that are adsorbed onto pressing surfaces 43*a* of heat pressing apparatus 43 are heated by the heater of heat pressing apparatus 43. Then, the plurality of antenna substrates 30 are pressed by heat pressing apparatus 43 against wiring substrate 10 while heating the plurality of antenna substrates 30 and wiring substrate 10 adsorbed onto pressing surfaces 43*a* of heat pressing apparatus 43 by heat pressing apparatus 43. Through the above-described steps, the plurality of antenna substrates 30 are substantially bonded onto wiring substrate 10 in a collective manner. The plurality of antenna substrates 30 are finally bonded and fixed onto wiring substrate 10 in a collective manner, so that array antenna apparatus 5*b* having a plurality of antenna substrates 30 joined onto wiring substrate 10 can be obtained.

In this way, in order to substantially bond the plurality of antenna substrates 30 onto wiring substrate 10, the plurality of antenna substrates 30 and wiring substrate 10 are adsorbed onto pressing surfaces 43*a* of heat pressing apparatus 43 during a time period from before heating of adhesive film 6 until completion of substantial bonding of the plurality of antenna substrates 30 onto wiring substrate 10. Accordingly, even if the temperature of the heater of heat pressing apparatus 43 is raised to soften adhesive film 6 in order to substantially bond the plurality of antenna substrates 30 onto wiring substrate 10, each antenna substrate 30 can be prevented from deviating from the position for antenna substrate 30 aligned in the step of temporarily bonding the plurality of antenna substrates 30 onto wiring substrate 10. Consequently, the distance between fed patch antenna 18 and parasitic patch antenna 34 can be set at a design value, so that the inclination of parasitic patch antenna 34 relative to fed patch antenna 18 can be eliminated. Thus, the plurality of antenna elements 55 and array antenna apparatus 5*b* each having excellent antenna characteristics can be obtained with more reliability.

In addition, the step of substantially bonding the plurality of antenna substrates 30 onto wiring substrate 10 is carried out at a higher temperature and with higher pressing force than those in the step of temporarily bonding antenna substrate 36 with an adhesive film onto wiring substrate 10 (see FIGS. 21 and 22).

The number of antenna substrates 30 to be substantially bonded onto wiring substrate 10 in a collective manner by one pressing from heat pressing apparatus 43 provided with vacuum adsorption mechanism 50 and a heater may be more than one. In the present embodiment, all of the plurality of antenna substrates 30 are substantially bonded onto wiring substrate 10 in a collective manner by one pressing from heat pressing apparatus 43 provided with vacuum adsorption mechanism 50 and a heater. Accordingly, in the present embodiment, pressing surface 43*a* of heat pressing apparatus 43 with a heater and vacuum adsorption mechanism 50 are larger in size than wiring substrate 10 and the plurality of antenna substrates 30.

Fourth Embodiment

Referring to FIGS. 28 to 33, an array antenna apparatus 5*c* according to the fourth embodiment and a method of manufacturing array antenna apparatus 5*c* will be hereinafter described. Array antenna apparatus 5*c* of the fourth embodiment is a modification of array antenna apparatus 5 of the first embodiment. Array antenna apparatus 5*c* of the fourth embodiment basically has the same configuration and can achieve the same effect as those of array antenna apparatus 5 of the first embodiment shown in FIG. 4, but is different mainly in the following points.

In the first embodiment, array antenna apparatus 5 is obtained by joining the plurality of antenna substrates 30 onto wiring substrate 10 by adhesive film 6. On the other hand, in the present embodiment, array antenna apparatus 5*c* is obtained by joining the plurality of antenna substrates 30*c* onto wiring substrate 10*c* with solder 72.

Referring to FIGS. 28 to 33, in the present embodiment, antenna substrate 30*c* is obtained by providing, in place of second alignment mark 35 of the first embodiment, a plurality of second pads 71 on third surface 33 of second substrate 31.

Antenna substrate 30*c* of the present embodiment can be manufactured, for example, by the method described below. First, a double-sided printed circuit board having second surface 32 and third surface 33 each having copper foil formed thereon is prepared. A part of the copper foil formed on second surface 32 is etched to thereby form a plurality of parasitic patch antennas 34. A part of the copper foil formed on third surface 33 is etched to thereby form a plurality of second pads 71. Then, the double-sided printed circuit board having the plurality of parasitic patch antennas 34 and the plurality of second pads 71 formed thereon is subjected to cut-out processing, thereby obtaining a plurality of antenna substrates 30*c*. Thus, the outer shapes of second substrate 31 and antenna substrate 30 can be precisely adjusted, so that the antenna characteristics of the plurality of antenna elements 55 can be rendered uniform. Furthermore, the plurality of antenna substrates 30*c* can be manufactured with efficiency at low cost.

Figure 30:
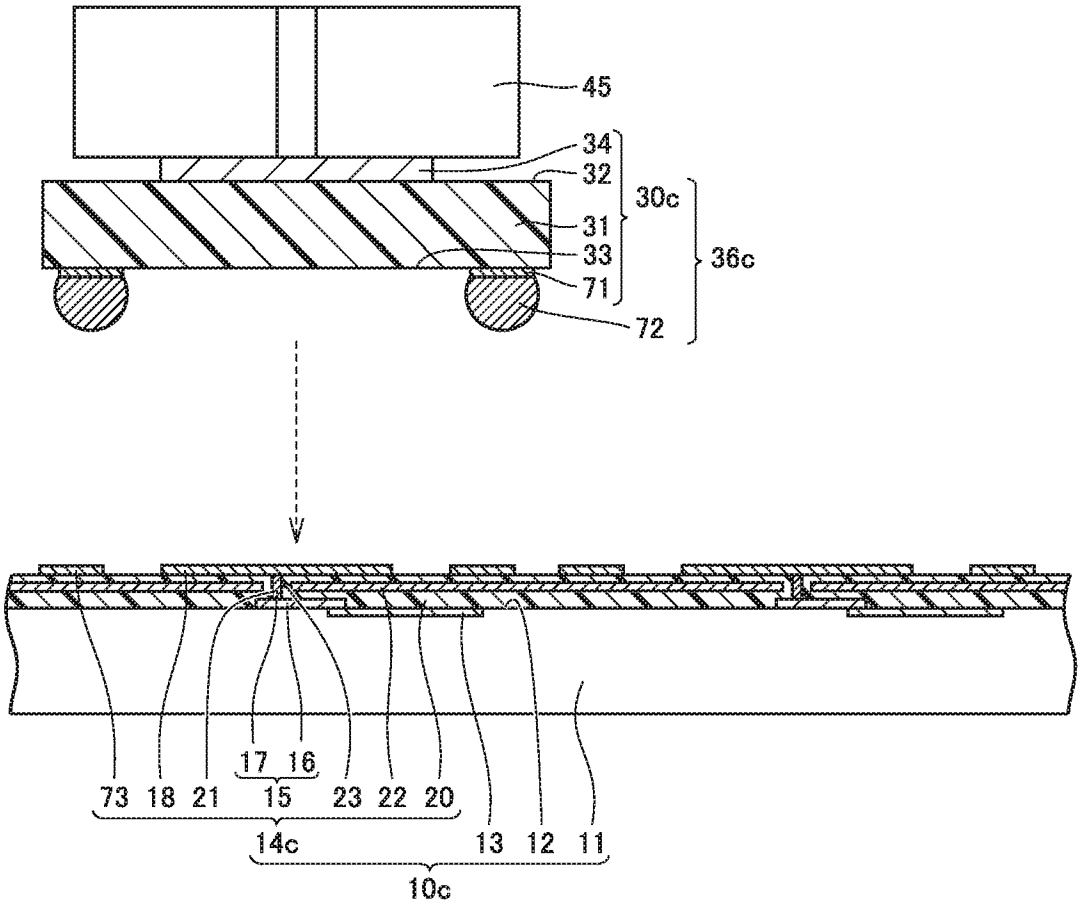
FIG. 30 is a schematic cross-sectional view of the manufacturing process of the array antenna apparatus according to the fourth embodiment of the present invention.
Figure 31:
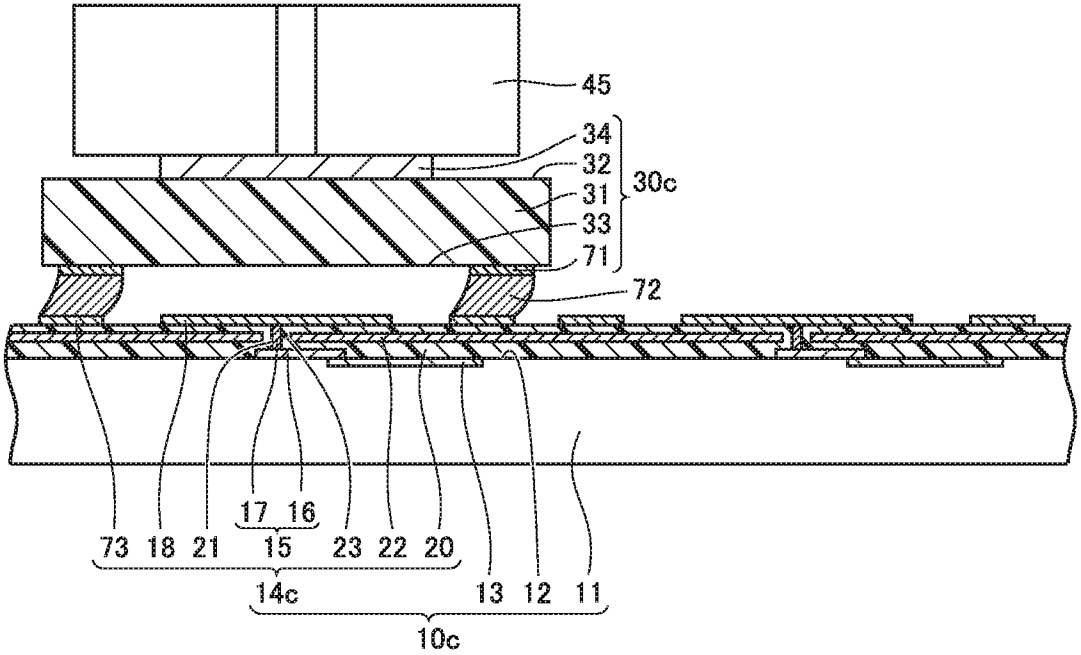
FIG. 31 is a schematic cross-sectional view of the manufacturing process of the array antenna apparatus according to the fourth embodiment of the present invention.
Figure 32:
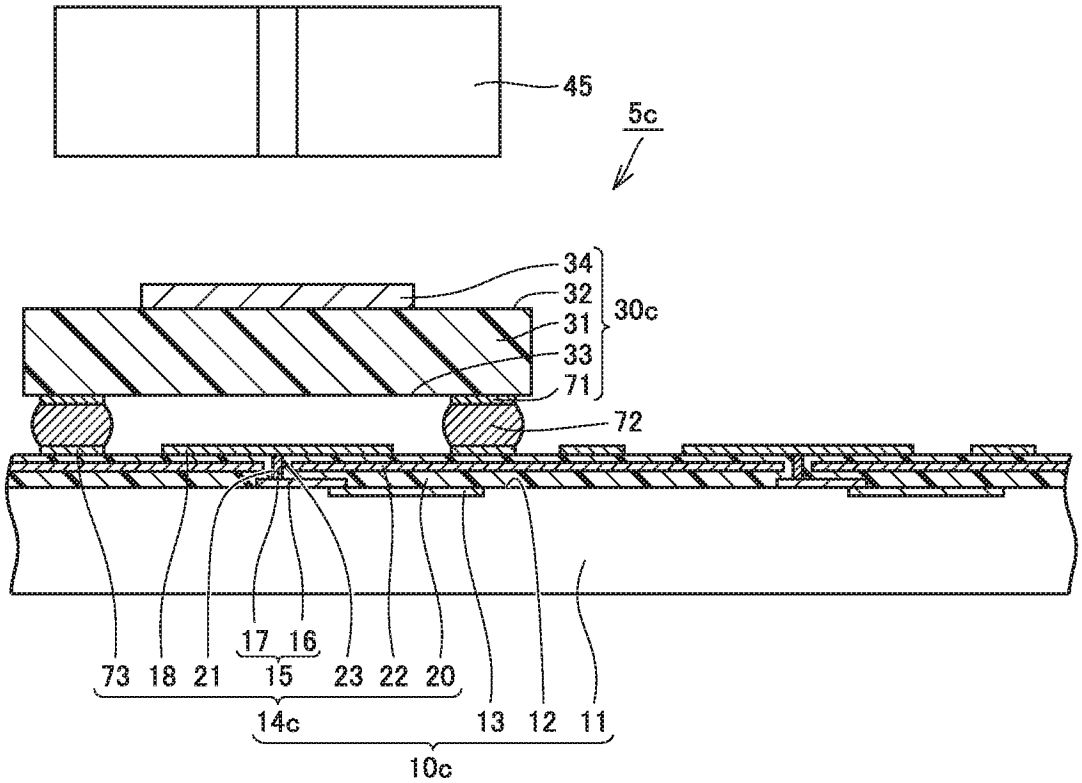
FIG. 32 is a schematic cross-sectional view of the manufacturing process of the array antenna apparatus according to the fourth embodiment of the present invention.

Referring to FIGS. 30 to 32, in the present embodiment, a plurality of first pads 73 are provided on wiring substrate 10*c* in place of first alignment mark 25 of the first embodiment. The plurality of first pads 73 may be provided on an insulating layer 20 of wiring layer 14*c* on which a plurality of fed patch antennas 18 are provided. When forming the plurality of fed patch antennas 18 or electrical connection 15 provided in insulating layer 20 of wiring layer 14*c*, the plurality of first pads 73 may be formed collectively with electrical connection 15 or the plurality of fed patch antennas 18. For example, a conductor formed on the surface of insulating layer 20 on the opposite side of first substrate 11 is etched, so that a plurality of fed patch antennas 18 and a plurality of first pads 73 can be collectively formed.

Figure 28:
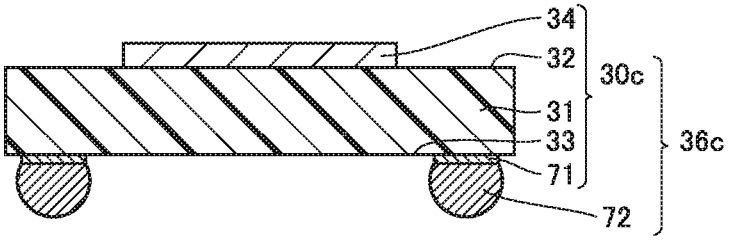
FIG. 28 is a schematic cross-sectional view of an antenna substrate with solder of an array antenna apparatus according to the fourth embodiment of the present invention.
Figure 29:
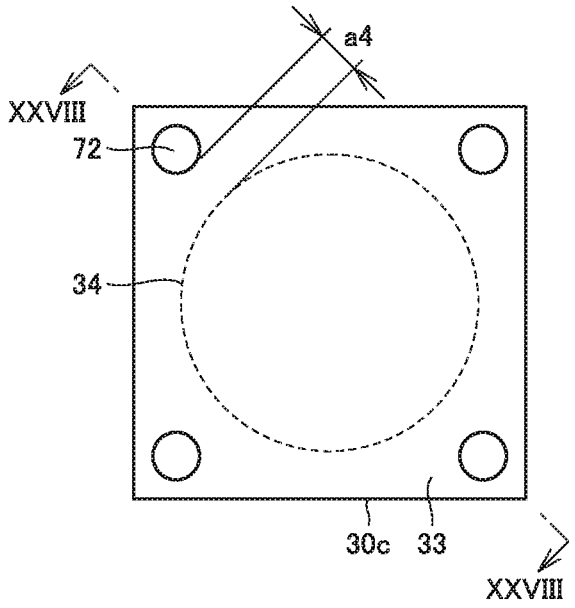
FIG. 29 is a schematic bottom view of the antenna substrate with solder of the array antenna apparatus according to the fourth embodiment of the present invention.
Figure 33:
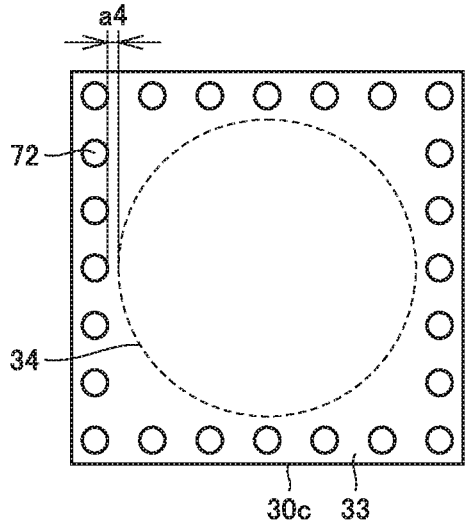
FIG. 33 is a schematic bottom view of an antenna substrate with solder of an array antenna apparatus according to a modification of the fourth embodiment of the present invention.

Solder 72 is provided on second pad 71 of each of the plurality of antenna substrates 30*c*, so that a plurality of antenna substrates 36*c* with solder can be obtained. As shown in FIGS. 28 and 29, the plurality of second pads 71 and solders 72 may be provided at corner portions on third surface 33 of antenna substrate 30. Alternatively, as shown in FIG. 33, the plurality of second pads 71 and solders 72 may be arranged in a manner of sequence of points along the outer periphery of third surface 33 of antenna substrate 30.

Referring to FIG. 30, antenna substrate 36*c* with solder is held by bonder head 45 with a heater (not shown). Then, solder 72 is heated by the heater of bonder head 45, and thus, solder 72 is molten.

Referring to FIG. 31, bonder head 45 with a heater is brought close to wiring substrate 10*c*, so that molten solder 72 in antenna substrate 36*c* with solder is brought into contact with first pad 73 on wiring substrate 10*c*. By the surface tension of molten solder 72, the position of antenna substrate 30*c* relative to wiring substrate 10*c* is automatically corrected (self alignment effect of solder) in a flat plane that is orthogonal to the thickness direction of wiring substrate 10*c* or antenna substrate 30*c* such that second pad 71 is located on first pad 73.

In the present embodiment, the position of antenna substrate 30*c* relative to wiring substrate 10*c* in a plane orthogonal to the thickness direction of wiring substrate 10*c* or antenna substrate 30*c* can be aligned by the self alignment effect of solder 72. Accordingly, first alignment mark 25 and second alignment mark 35 of the first embodiment do not need to be provided on wiring substrate 10*c* and antenna substrate 30*c*, respectively. As compared with the first embodiment, the present embodiment can eliminate the step of forming first alignment mark 25 and second alignment mark 35, so that the manufacturing process can be simplified.

As a modification of the present embodiment, as in the first embodiment, first alignment mark 25 may be provided on wiring substrate 10 (see FIG. 4) while at least some of solders 72 provided on the plurality of antenna substrates 30*c* may be provided with a function of an alignment mark. Then, solder 72 having a function of an alignment mark and first alignment mark 25 provided on wiring substrate 10 may be aligned with each other. Unlike the first embodiment, this modification can eliminate the step of forming second alignment mark 35, so that the manufacturing process can be simplified.

On third surface 33 of antenna substrate 30*c*, a conductor exists only at a position where solder 72 exists, but no conductor exists at a position where solder 72 does not exist. Thus, when solder 72 exists at a position in the proximity of parasitic patch antenna 34, the antenna characteristics of array antenna apparatus 5*c* may deviate from the design values. As a result of the electromagnetic field simulation, it has been found that the antenna characteristics of array antenna apparatus 5*c* are not influenced as long as the shortest distance a4 between solder 72 and parasitic patch antenna 34 (see FIGS. 29 and 33) is 0.2 mm or more in a plan view of antenna substrate 36*c* with solder as seen from the third surface 33 side. Accordingly, in the present embodiment, the shortest distance a4 between solder 72 and parasitic patch antenna 34 in a plan view of antenna substrate 36*c* with solder as seen from the third surface 33 side is set at 0.2 mm.

In array antenna apparatus 5*c* of the present embodiment, a plurality of antenna substrates 30*c* are joined onto one wiring substrate 10*c*. The outer periphery of each of the plurality of antenna substrates 30*c* in a plane orthogonal to the thickness direction of each of the plurality of antenna substrates 30*c* is smaller than the outer periphery of wiring substrate 10*c* in a plane orthogonal to the thickness direction of wiring substrate 10*c*. Accordingly, it becomes possible to reduce warpage, torsion or distortion caused in wiring substrate 10*c* and the plurality of antenna substrates 30*c* by (1) the cooling process performed after joining the plurality of antenna substrates 30*c* onto wiring substrate 10*c* with solder 72 while heating these antenna substrates 30*c*, or (2) the heat emitted from array antenna apparatus 5*c* during use of array antenna apparatus 5*c*. Thus, in array antenna apparatus 5*c* having a plurality of antenna elements 55 of the present embodiment, the positional misalignment among the plurality of antenna elements 55 can be reduced, so that array antenna apparatus 5*c* having the antenna characteristics as designed can be obtained.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 housing, 2 base plate, 3 carrier, 4 adhesive layer, 5, 5*a*, 5*b*, 5*c* array antenna apparatus, 6 adhesive film, 7, 8 control substrate, 9 pad, 10, 10*c* wiring substrate, 11 first substrate, 12 first surface, 13 active element circuit, 14, 14*c* wiring layer, 15 electrical connection, 16 first electrical connection portion, 17 second electrical connection portion, 18 fed patch antenna, 20 insulating layer, 21 via hole, 22 ground conductor layer, 23 opening, 25 first alignment mark, 30, 30*a*, 30*b*, 30*c* antenna substrate, 31 second substrate, 32 second surface, 33 third surface, 34 parasitic patch antenna, 35 second alignment mark, 36 antenna substrate with adhesive film, 36*c* antenna substrate with solder, 39 heating stage, 40 mold releasing layer, 43 heat pressing apparatus, 43*a* pressing surface, 45 bonder head, 50 vacuum adsorption mechanism, 51 opening, 52 exhaust port, 55 antenna element, 63, 63*a*, 63*b* cutout portion, 64 portion, 71 second pad, 72 solder, 73 first pad, M positional misalignment amount, P, P1 pitch, S setback, T thickness of adhesive film.

The invention claimed is:

1. An array antenna apparatus comprising:

a wiring substrate; and a plurality of antenna substrates, the wiring substrate including a first substrate that has a first surface and a wiring layer that is provided on the first surface of the first substrate, the first substrate having a plurality of active element circuits provided on the first surface, each of the plurality of active element circuits being configured to perform at least one of transmission or reception of an electromagnetic wave, the wiring layer having a plurality of patch antennas and an electrical connection, and each of the plurality of patch antennas being electrically connected to each of the plurality of active element circuits by the electrical connection, each of the plurality of antenna substrates including a second substrate that has a second surface and a third surface on an opposite side of the second surface, and at least one parasitic patch antenna that is provided on the second surface of the second substrate, wherein each of the plurality of patch antennas feeds a signal to the at least one parasitic patch antenna, the plurality of antenna substrates being joined onto one wiring substrate, with a gap between adjacent antenna substrates, including the second substrate, of the plurality of antenna substrates, and a distance between the plurality of patch antennas and the first surface is shorter than a distance between the plurality of patch antennas and the third surface.

2. The array antenna apparatus according to claim 1, wherein the first substrate is a semiconductor wafer, and the second substrate is a printed circuit board.

3. The array antenna apparatus according to claim 1, wherein the first substrate is one of an Si substrate, an SiGe substrate, a GaAs substrate, an InP substrate, a GaSb substrate, an SiC substrate, and a GaN substrate.

4. The array antenna apparatus according to claim 1, wherein the wiring layer further has an insulating layer, and at least a part of the electrical connection is provided inside the insulating layer.

5. The array antenna apparatus according to claim 4, wherein the insulating layer contains resin.

6. The array antenna apparatus according to claim 1, wherein the wiring layer further has a ground conductor layer, the ground conductor layer is provided between the plurality of active element circuits and the plurality of patch antennas, and the ground conductor layer is one conductor layer extending in a region larger than a region in which the plurality of patch antennas are arranged.

7. The array antenna apparatus according to claim 1, wherein the third surface of each of the plurality of antenna substrates is joined onto the wiring layer of the wiring substrate, and each of the plurality of antenna substrates has a thickness defined by a distance between the second surface and the third surface of each of the plurality of antenna substrates, the thickness being 100 μm or more and 1 mm or less.

8. The array antenna apparatus according to claim 1, wherein the wiring substrate includes an alignment mark, and each of the plurality of antenna substrates includes an alignment mark.

9. The array antenna apparatus according to claim 1, wherein the gap between the plurality of antenna substrates is 0.1 mm or more and 1.2 mm or less, and the gap is filled with air.

10. The array antenna apparatus according to claim 1, wherein the gap between the plurality of antenna substrates is 0.2 mm or more and 0.6 mm or less, and the gap is filled with air.

11. An array antenna apparatus comprising:

a wiring substrate; and a plurality of antenna substrates, the wiring substrate including a first substrate that has a first surface and a wiring layer that is provided on the first surface of the first substrate, the first substrate having a plurality of active element circuits provided on the first surface, each of the plurality of active element circuits being configured to perform at least one of transmission or reception of an electromagnetic wave, the wiring layer having a plurality of patch antennas and an electrical connection, and each of the plurality of patch antennas being electrically connected to each of the plurality of active element circuits by the electrical connection, each of the plurality of antenna substrates including a second substrate that has a second surface and a third surface on an opposite side of the second surface, and at least one parasitic patch antenna that is provided on the second surface of the second substrate, wherein each of the plurality of patch antennas feeds a signal to the at least one parasitic patch antenna, the plurality of antenna substrates being joined onto one wiring substrate, with a gap between adjacent antenna substrates, including the second substrate, of the plurality of antenna substrates, a distance between the plurality of patch antennas and the first surface is shorter than a distance between the plurality of patch antennas and the third surface, and a plurality of adhesive films are arranged between the third surface of each of the plurality of antenna substrates and the first surface of the wiring substrate, wherein each of the plurality of antenna substrates are joined onto the first surface of the wiring substrate by a respective adhesive film of the plurality of adhesive films.

12. The array antenna apparatus according to claim 11, wherein the adhesive film contains resin.

13. The array antenna apparatus according to claim 11, wherein the adhesive film has a dielectric loss tangent of 0.005 or less.

14. The array antenna apparatus according to claim 1, wherein solder is arranged between the third surface of each of the plurality of antenna substrates and the wiring substrate, and the plurality of antenna substrates are joined onto the wiring substrate with solder.

15. The array antenna apparatus according to claim 1, wherein the second substrate has a dielectric loss tangent of 0.003 or less.

16. A method of manufacturing an array antenna apparatus, the method comprising:

forming a wiring substrate;

forming a plurality of antenna substrates; and joining the plurality of antenna substrates onto one wiring substrate, the forming a wiring substrate including forming a plurality of active element circuits on a first surface of a first substrate, each of the plurality of active element circuits being configured to perform at least one of transmission or reception of an electromagnetic wave, and forming a wiring layer on the first surface of the first substrate, the wiring layer having a plurality of patch antennas and an electrical connection, and each of the plurality of patch antennas being electrically connected to each of the plurality of active element circuits by the electrical connection, and the forming a plurality of antenna substrates including providing at least one parasitic patch antenna on a second surface of a second substrate wherein each of the plurality of patch antennas feeds a signal to the at least one parasitic patch antenna, wherein the plurality of antenna substrates being joined onto one wiring substrate, with a gap between adjacent antenna substrates, including the second substrate, of the plurality of antenna substrates, and a distance between the plurality of patch antennas and the first surface is shorter than a distance between the plurality of patch antennas and the third surface.

17. The method of manufacturing an array antenna apparatus according to claim 16, wherein the joining the plurality of antenna substrates includes aligning the plurality of antenna substrates with the wiring substrate while observing a first alignment mark formed on the wiring substrate and a second alignment mark formed on each of the plurality of antenna substrates.

18. The method of manufacturing an array antenna apparatus according to claim 16, wherein the joining the plurality of antenna substrates includes determining a center position of each of the plurality of patch antennas and a center position of the parasitic patch antenna of each of the plurality of antenna substrates, and aligning each of the plurality of antenna substrates with the wiring substrate such that the center position of each of the plurality of patch antennas and the center position of the parasitic patch antenna are located to correspond to each other.

19. The method of manufacturing an array antenna apparatus according to claim 16, wherein the joining the plurality of antenna substrates includes a first bonding of temporarily bonding an adhesive film onto the plurality of antenna substrates, and a second bonding of substantially bonding the plurality of antenna substrates onto the wiring substrate by the adhesive film.

20. The method of manufacturing an array antenna apparatus according to claim 17, wherein the joining the plurality of antenna substrates includes a first bonding of temporarily bonding an adhesive film onto the plurality of antenna substrates, and a second bonding of substantially bonding the plurality of antenna substrates having the adhesive film onto the wiring substrate, and in the first bonding, the adhesive film is temporarily bonded onto the plurality of antenna substrates so as to prevent the adhesive film from covering the second alignment mark on each of the plurality of antenna substrates.

21. The method of manufacturing an array antenna apparatus according to claim 19, wherein the second bonding includes temporarily bonding the plurality of antenna substrates having the adhesive film onto the wiring substrate; and a third bonding of using a heat pressing apparatus to press the plurality of antenna substrates temporarily bonded onto the wiring substrate collectively against the wiring substrate while heating the plurality of antenna substrates temporarily bonded onto the wiring substrate, to substantially bond the plurality of antenna substrates collectively onto the wiring substrate.

22. The method of manufacturing an array antenna apparatus according to claim 21, wherein the third bonding includes causing the plurality of antenna substrates and the wiring substrate to adsorb onto the heat pressing apparatus during a time period from before heating the plurality of antenna substrates temporarily bonded onto the wiring substrate until completion of substantial bonding of the plurality of antenna substrates collectively onto the wiring substrate.

23. The method of manufacturing an array antenna apparatus according to claim 16, wherein the joining the plurality of antenna substrates includes joining the wiring substrate and the plurality of antenna substrates to each other with solder.

24. The method of manufacturing an array antenna apparatus according to claim 16, wherein the joining the plurality of antenna substrates includes joining each of the plurality of antenna substrates to the one wiring substrate by a respective adhesive film of a plurality of adhesive films provided to each of the plurality of antenna substrates.

* * * * *